US009834932B2

(12) United States Patent
Yesil

(10) Patent No.: US 9,834,932 B2
(45) Date of Patent: Dec. 5, 2017

(54) COMPOSITE STRUCTURE MEMBERS FOR CONSTRUCTION OF MULTI-FLOOR STRUCTURES

(71) Applicant: Renco World Corporation, Miami, FL (US)

(72) Inventor: Kamil Engin Yesil, Istanbul (TR)

(73) Assignee: Renco World Corporation, Miami, FL (US)

( * ) Notice: Subject to any disclaimer, the term of this patent is extended or adjusted under 35 U.S.C. 154(b) by 0 days.

(21) Appl. No.: 14/630,900

(22) Filed: Feb. 25, 2015

(65) Prior Publication Data

US 2015/0240485 A1 Aug. 27, 2015

(30) Foreign Application Priority Data

Feb. 26, 2014 (TR) ..... 2014/02257

(51) Int. Cl.
*E04C 3/28* (2006.01)
*E04B 2/18* (2006.01)
(Continued)

(52) U.S. Cl.
CPC ..... *E04C 3/28* (2013.01); *E04B 1/12* (2013.01); *E04B 1/14* (2013.01); *E04B 1/54* (2013.01); *E04B 2/18* (2013.01); *E04B 5/02* (2013.01); *E04B 5/026* (2013.01); *E04C 1/00* (2013.01); *E04C 1/39* (2013.01); *E04C 1/40* (2013.01); *E04B 2002/0228* (2013.01); *E04B 2002/0232* (2013.01)

(58) Field of Classification Search
CPC ..... E04C 1/40; E04C 1/39; E04C 3/28; E04B 5/02; E04B 1/54; E04B 5/026; E04B 2/18; E04B 2002/0232; E04B 2002/0228; E04B 1/12; E04B 1/14; A63H 33/08; A63H 33/082; A63H 33/084; A63H 33/086; A63H 33/088
USPC ..... 446/128
See application file for complete search history.

(56) References Cited

U.S. PATENT DOCUMENTS 2,461,535 A * 2/1949 Erhardt ..... A63H 33/088 446/104
3,148,477 A * 9/1964 Bjphirn ..... A63H 33/082 446/106
(Continued)

FOREIGN PATENT DOCUMENTS

CH 112341 A 10/1925
DE 2602000 A1 7/1977
(Continued)

OTHER PUBLICATIONS

International Search Report and Written Opinion for Application No. PCT/TR2014/000493 dated May 15, 2015.

*Primary Examiner* — Brian Glessner
*Assistant Examiner* — Adam Barlow
(74) *Attorney, Agent, or Firm* — Lerner, David, Littenberg, Krumholz & Mentlik, LLP

(57) ABSTRACT

The present invention relates to structure members having a body made of a composite material comprising at least one type of fiber and at least one type of resin, and pluralities of connection extensions which are one-piece with said body in order to provide connection to another structure member with the same properties, and the present invention relates to a structure formed by said structure members.

11 Claims, 17 Drawing Sheets

(51) Int. Cl.

| | |
|---|---|
| ***E04B 1/14*** | (2006.01) |
| ***E04C 1/00*** | (2006.01) |
| ***E04C 1/39*** | (2006.01) |
| ***E04B 5/02*** | (2006.01) |
| ***E04B 1/12*** | (2006.01) |
| ***E04B 1/61*** | (2006.01) |
| ***E04C 1/40*** | (2006.01) |
| *E04B 2/02* | (2006.01) |

(56) References Cited

U.S. PATENT DOCUMENTS 4,516,364 A * 5/1985 Heider ..... E04C 1/40 52/590.1
5,061,218 A * 10/1991 Garage ..... A63H 33/086 446/102
5,226,275 A * 7/1993 Trahan ..... E04B 2/18 446/120
5,471,808 A * 12/1995 De Pieri ..... E04B 2/18 446/128
6,050,044 A * 4/2000 McIntosh ..... A63H 33/086 446/124
D467,288 S * 12/2002 Sorensen ..... D21/500
D470,196 S * 2/2003 Sorensen ..... D21/499
6,648,715 B2 * 11/2003 Wiens ..... A63H 33/062 446/121
6,948,282 B2 * 9/2005 Bott ..... E04C 1/395 52/592.6
7,694,485 B1 * 4/2010 Siener ..... E04B 2/18 52/570
D748,204 S * 1/2016 Simonds ..... D21/500
2013/0165013 A1 * 6/2013 Chin ..... A63H 33/086 446/124

FOREIGN PATENT DOCUMENTS

GB 2113741 A 8/1983
GB 2188079 A 9/1987
TR WO 2012100843 A1 * 8/2012 ..... E04B 2/18
WO 2012100843 A1 8/2012

* cited by examiner

COMPOSITE STRUCTURE MEMBERS FOR CONSTRUCTION OF MULTI-FLOOR STRUCTURES

CROSS-REFERENCE TO RELATED APPLICATIONS

The present application claims priority from Turkish Application NO. 2014/02257, filed Feb. 26, 2014, the disclosure of which is hereby incorporated herein by reference.

BACKGROUND OF THE INVENTION

The present invention relates to structure members having a body made of a composite material comprising at least one type of fiber and at least one type of resin, and pluralities of connection extensions which are one-piece with said body in order to provide connection to another structure member with the same properties, and the present invention relates to a structure formed by said structure members.

In construction sector, structures are frequently made of concrete, brick and steel-based materials. The bases, intermediate floor bases and ceilings of the structures are made of concrete material. The desired insulation cannot be provided in concrete structures, and therefore, composite structures are begun to be formed. In order for the composite structures to be produced, the floor shall be formed. In order to begin production of the structure, there is the possibility that there is no concrete in the region where the structure is to be produced. In this case, production begins in a lagged manner.

Moreover, even if insulation is provided on the intermediate floor bases completely formed from composite material, the noise, occurring as a result of the force applied to the base, may reach the bottom floors. The produced intermediate floor bases are heavy, the assembly thereof is difficult, the installation takes long time, and the labor cost is high.

Since the material forming the ceiling at the uppermost floor of the structure is concrete, cold air enters into the structure in winter, and hot air enters into the structure in summer, in other words, the desired insulation cannot be provided.

Moreover, the beams used in structures are heavy, and they have a high cost, and production and assembly thereof are difficult. The beams cannot be produced by means of joining by using materials like styrofoam and foam.

As a result, because of the abovementioned problems, an improvement is required in the related technical field.

SUMMARY OF THE INVENTION

The present invention relates to composite structure members for construction of multi-floor structures, for eliminating the above mentioned disadvantages and for bringing new advantages to the related technical field.

The main object of the present invention is to provide a structure where insulation is improved and where the structure members are engaged to each other in a firmer manner.

Another object of the present invention is to provide a structure having structure members where the assembly is facilitated and where the costs are lowered.

Another object of the present invention is to provide a structure which can be installed without the need for pouring base concrete.

In order to realize all of the abovementioned objects and the objects which are to be obtained from the detailed description below, the present invention is a structure member having a body made of a composite material comprising at least one type of fiber and at least one type of resin, and pluralities of third connection extensions which are one-piece with said body in order to provide connection to another structure member with the same properties. As an improvement, the present invention is characterized in that at least two third connection extensions are provided on a beam adaptor width section of the body, and there is at least one beam housing wherein at least one beam is placed and provided along at least one section of the body height and between at least one row of third connection extensions provided in a beam adaptor length section of the body.

In a preferred embodiment of the subject matter invention, there is at least one adaptor connection recess or at least one adaptor connection protrusion provided on at least one surface thereof facing another structure member which is horizontally adjacent.

In a preferred embodiment of the subject matter invention, two adaptor connection recesses or adaptor connection protrusions are provided.

In a preferred embodiment of the subject matter invention, each beam housing is provided along half length of the beam adaptor width section and along half length of the height thereof.

In a preferred embodiment of the subject matter invention, each beam housing is provided along the half length of the beam adaptor width section and along the whole height thereof.

In a preferred embodiment of the subject matter invention, each beam housing is provided along the whole length of the beam adaptor width section and along the half-length thereof.

In a preferred embodiment of the subject matter invention, there are pluralities of third connection housings provided in the direction of the third connection extensions and at the bottom section of the body.

In a preferred embodiment of the subject matter invention, in order to provide resistance, the subject matter structure member is made of composite material comprising at least one type of fiber at a proportion of 25-33%, at least one type of mineral powder as filling material at a proportion of 40-50%, at least one type of resin at a proportion of 20-25% as binding member between the fiber and filling material, and at least one chemical additive at a proportion of 5-8%.

In a preferred embodiment of the subject matter invention, in order to obtain a material having the mechanical properties of steels which are ST 50 and above, vinyl ester resin is used as resin, and carbon fiber is used as fiber.

In a preferred embodiment of the subject matter invention, in order to obtain a material having the mechanical properties of steels which are between ST 33 and ST 42, orthophthalic resin is used as resin, and glass fiber is used as fiber.

In a preferred embodiment of the subject matter invention, in order to obtain a material having the mechanical properties of steels which are between ST 42 and ST 50, isophthalic resin is used as resin, and aramid fiber is used as fiber.

In a preferred embodiment of the subject matter invention, there is at least one type of mineral powder which is selected from a mineral group comprising silisium dioxide, barite, talc and calcite as the filling material.

In a preferred embodiment of the subject matter invention, there is at least one of the chemicals increasing resistance against abrasion, resistance against flame and increasing water absorption; and moreover, optionally, there is predetermined amount of thermoplastic material for improving visual appearance of the surface.

Moreover, the present invention is a structure member having a body made of a composite material comprising at least one type of fiber and at least one type of resin, and pluralities of fourth connection extensions which are one-piece with said body in order to provide connection to another structure member with the same properties. As an improvement, the present invention is characterized in that at least two fourth connection extensions are provided on a panel adaptor width section of the body, and there is a panel connection section wherein a panel is placed horizontally and provided in a step form horizontally at least towards one side from the base section of the body.

In a preferred embodiment of the subject matter invention, there are pluralities of fourth connection housings provided in the direction of the fourth connection extensions and at the bottom section of the body.

In a preferred embodiment of the subject matter invention, there is at least one beam connection housing wherein a beam is placed and provided along the height of the body and between the fourth connection extensions provided at a panel adaptor length section of the body.

In a preferred embodiment of the subject matter invention, the body comprises at least one wall connection arm where the fourth connection extensions are provided.

In a preferred embodiment of the subject matter invention, there are at least two wall connection arms extending at a certain angle with respect to each other.

In a preferred embodiment of the subject matter invention, the wall connection arms are embodied in L or T-like form.

In a preferred embodiment of the subject matter invention, at least one panel adaptor connection recess or at least one panel adaptor connection protrusion is provided on at least one surface thereof facing another structure member which is horizontally adjacent.

In a preferred embodiment of the subject matter invention, two panel adaptor connection recesses or two panel adaptor connection protrusions are provided.

In a preferred embodiment of the subject matter invention, in order to provide resistance, the subject matter structure member is made of composite material comprising at least one type of fiber at a proportion of 25-33%, at least one type of mineral powder as filling material at a proportion of 40-50%, at least one type of resin at a proportion of 20-25% as binding member between the fiber and filling material, and at least one chemical additive at a proportion of 5-8%.

In a preferred embodiment of the subject matter invention, in order to obtain a material having the mechanical properties of steels which are ST 50 and above, vinyl ester resin is used as resin, and carbon fiber is used as fiber.

In a preferred embodiment of the subject matter invention, in order to obtain a material having the mechanical properties of steels which are between ST 33 and ST 42, orthophthalic resin is used as resin, and glass fiber is used as fiber.

In a preferred embodiment of the subject matter invention, in order to obtain a material having the mechanical properties of steels which are between ST 42 and ST 50, isophthalic resin is used as resin, and aramid fiber is used as fiber.

In a preferred embodiment of the subject matter invention, there is at least one type of mineral powder which is selected from a mineral group comprising silisium dioxide, barite, talc and calcite as the filling material.

In a preferred embodiment of the subject matter invention, there is at least one of the chemicals increasing resistance against abrasion, resistance against flame and increasing water absorption; and moreover, optionally, there is predetermined amount of thermoplastic material for improving visual appearance of the surface.

Moreover, the present invention is a modular structure produced by joining composite structure members. As an improvement; as the structure member, said modular structure is made of a composite material comprising at least one type of fiber, and at least one type of resin;

- at least one beam having a support section extending along the long edge inwardly from at least one long edge thereof,
- a beam adaptor having at least one beam housing wherein the beam is placed and provided along at least one section of the body height and between at least one row of third connection extensions provided at a beam adaptor length section provided on the connection extensions of the structure member whereon it is placed;
- a panel adaptor having a panel connection section where a panel is horizontally placed and provided in a step form horizontally towards at least one side from the base section of the panel adaptor body and a panel adaptor body having at least one fourth extension opening,
- a panel having at least one panel connection protrusion or at least one panel connection recess on the surface facing at least one adjacent structure member and connected to the panel connection section and placed on the beams.

In a preferred embodiment of the subject matter invention, the beam adaptor comprises at least one adaptor connection recess or at least one adaptor connection protrusion provided on at least one surface facing another horizontally adjacent structure member.

In a preferred embodiment of the subject matter invention, the beam housing is provided along half length of the beam adaptor width section and along half length of the height thereof.

In a preferred embodiment of the subject matter invention, the beam housing is provided along the half length of the beam adaptor width section and along the whole height thereof.

In a preferred embodiment of the subject matter invention, the beam housing is provided along the whole length of the beam adaptor width section and along the half-length thereof.

In a preferred embodiment of the subject matter invention, the beam adaptor comprises pluralities of third connection housings provided in the direction of the third connection extensions at the bottom section of the beam adaptor body.

In a preferred embodiment of the subject matter invention, the panel adaptor comprises pluralities of fourth connection housings provided in the direction of the fourth connection extensions at the bottom section of the panel adaptor body.

In a preferred embodiment of the subject matter invention, the panel adaptor comprises at least one beam connection housing wherein a beam is placed and provided along the body height and between the fourth connection extensions provided at the panel adaptor length section.

In a preferred embodiment of the subject matter invention, the panel adaptor comprises at least one wall connection arm where the fourth connection extensions are provided.

In a preferred embodiment of the subject matter invention, the panel adaptor comprises at least two wall connection arms extending at a certain angle with respect to each other.

In a preferred embodiment of the subject matter invention, the wall connection arms are embodied in an L or T-like form.

In a preferred embodiment of the subject matter invention, the panel adaptor comprises at least one panel adaptor connection recess or at least one panel adaptor connection protrusion provided on at least one surface facing another horizontally adjacent structure member.

In a preferred embodiment of the subject matter invention, two panel adaptor connection recesses or two panel adaptor connection protrusions are provided.

In a preferred embodiment of the subject matter invention, the support section of the beam is provided in the vicinity of the two mutual long edges.

In a preferred embodiment of the subject matter invention, the inner section provided outside of the support sections is hollow.

In a preferred embodiment of the subject matter invention, the inner section provided outside of the support sections is filled with foam material.

In a preferred embodiment of the subject matter invention, the beam comprises at least one beam rib extending longitudinally in the inner section thereof.

In a preferred embodiment of the subject matter invention, the inner section of the panel is filled with styrofoam material.

In a preferred embodiment of the subject matter invention, there is at least one panel rib extending longitudinally in the inner section of the panel.

In a preferred embodiment of the subject matter invention, there is a beginning body having pluralities of first connection extensions, at least one first connection housing provided on the base of said beginning body, and at least two beginning bricks each of which has at least one connection channel on the lateral surface of at least one beginning brick and which are positioned with respect to each other such that one of them corresponds to the connection channel of the other one and thus such that a placement channel is defined.

In a preferred embodiment of the subject matter invention, at least two first connection extensions are provided in the beginning body width section.

In a preferred embodiment of the subject matter invention, the beginning brick comprises a placement channel provided along the body height in the section where each of the four first connection extensions faces each other.

In a preferred embodiment of the subject matter invention, in order to provide resistance, the subject matter structure member is made of composite material comprising at least one type of fiber at a proportion of 25-33%, at least one type of mineral powder as filling material at a proportion of 40-50%, at least one type of resin at a proportion of 20-25% as binding member between the fiber and filling material, and at least one chemical additive at a proportion of 5-8%.

In a preferred embodiment of the subject matter invention, in order to obtain a material having the mechanical properties of steels which are ST 50 and above, vinyl ester resin is used as resin, and carbon fiber is used as fiber.

In a preferred embodiment of the subject matter invention, in order to obtain a material having the mechanical properties of steels which are between ST 33 and ST 42, orthophthalic resin is used as resin, and glass fiber is used as fiber.

In a preferred embodiment of the subject matter invention, in order to obtain a material having the mechanical properties of steels which are between ST 42 and ST 50, isophthalic resin is used as resin, and aramid fiber is used as fiber.

In a preferred embodiment of the subject matter invention, there is at least one type of mineral powder which is selected from a mineral group comprising silisium dioxide, barite, talc and calcite as the filling material.

In a preferred embodiment of the subject matter invention, there is at least one of the chemicals increasing resistance against abrasion, resistance against flame and increasing water absorption; and moreover, optionally, there is predetermined amount of thermoplastic material for improving visual appearance of the surface.

REFERENCE NUMBERS

Figure 1A:
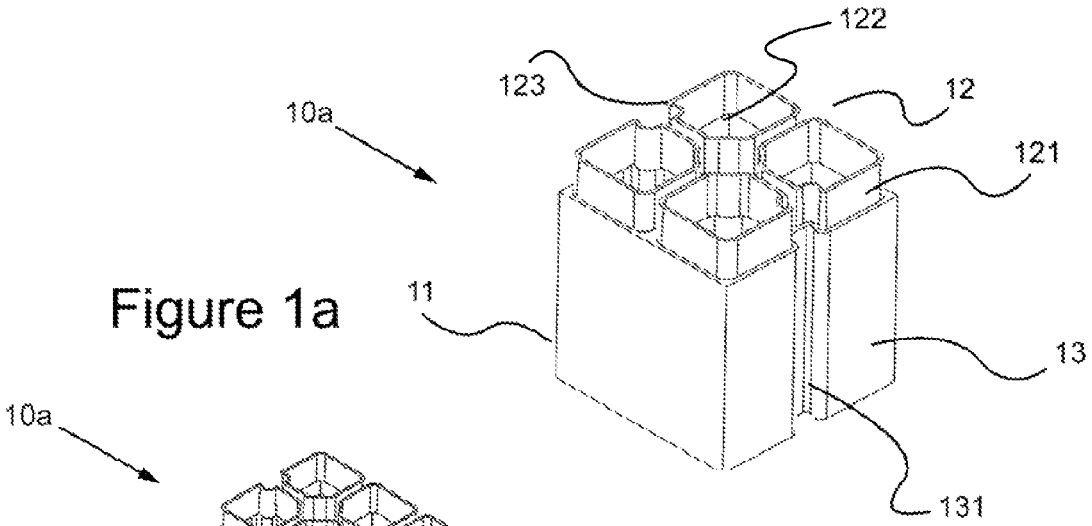
In FIG. 1*a*, a general view of the subject matter flat beginning brick is given.
Figure 1B:
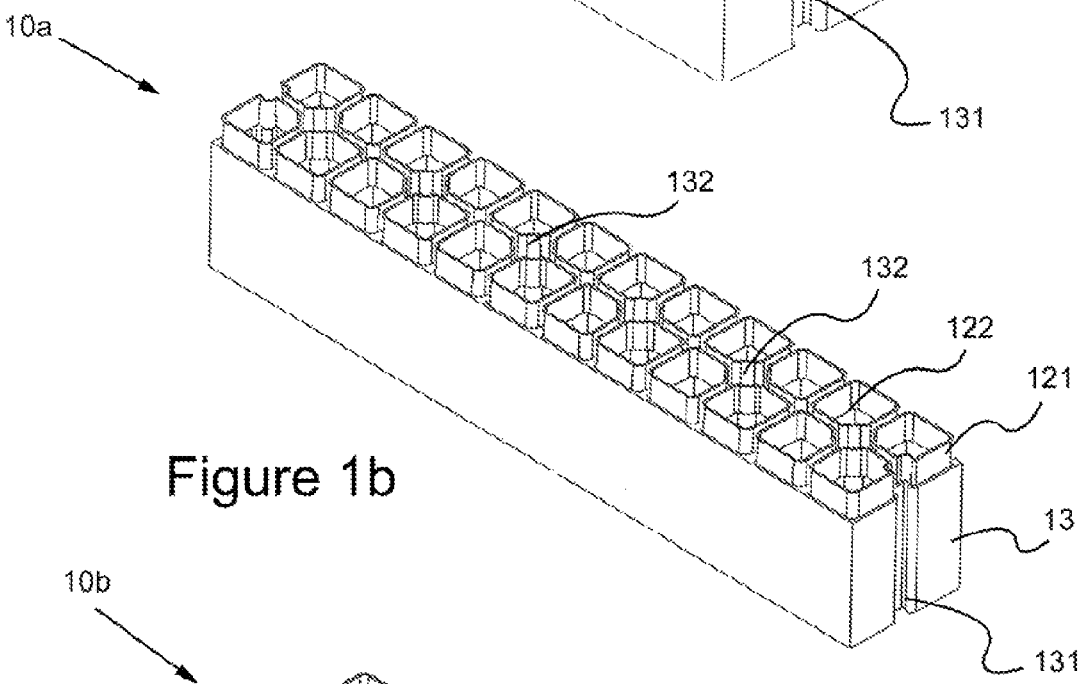
In FIG. 1*b*, a general view of the subject matter flat beginning brick is given.
Figure 1C:
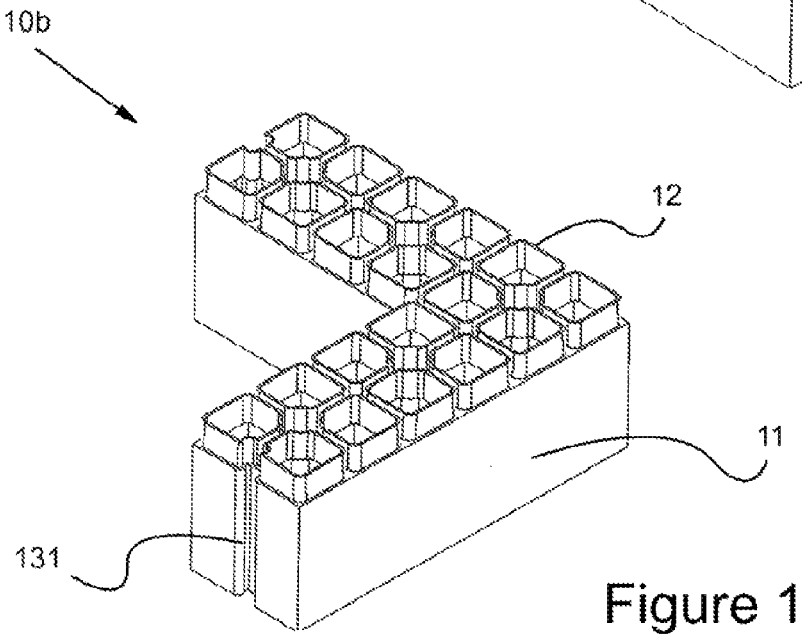
In FIG. 1*c*, a general view of the corner beginning brick is given.
Figure 1D:
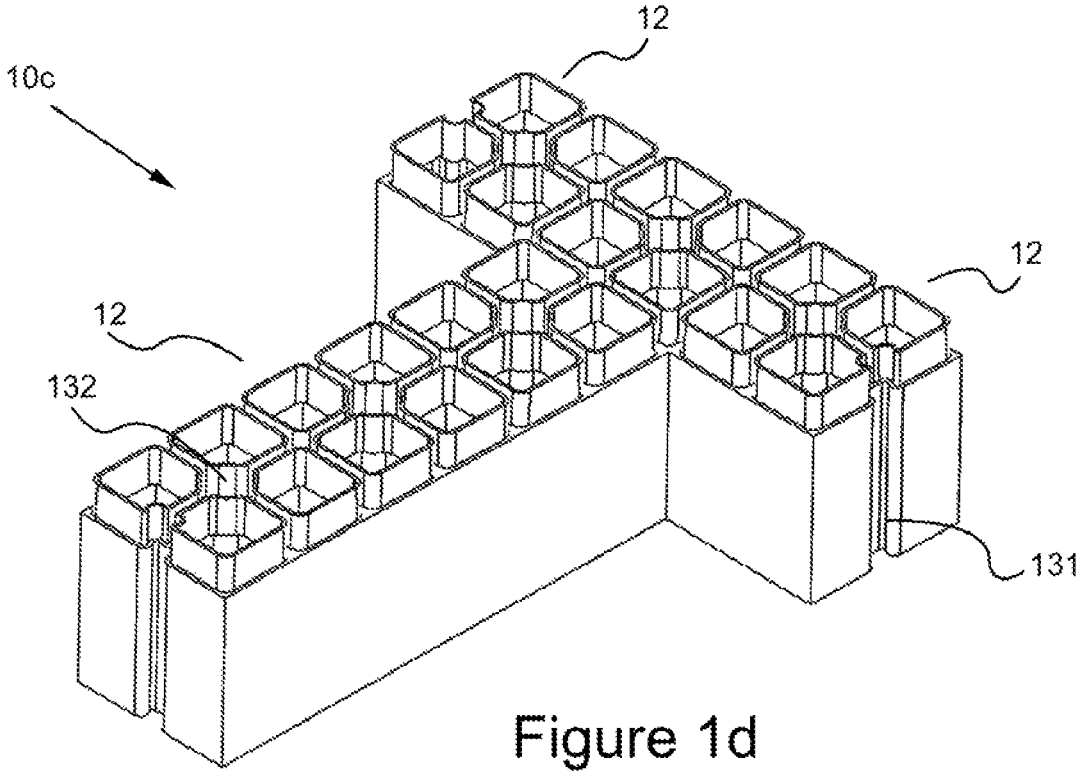
In FIG. 1*d*, a general view of the T beginning brick is given.
Figure 1E:
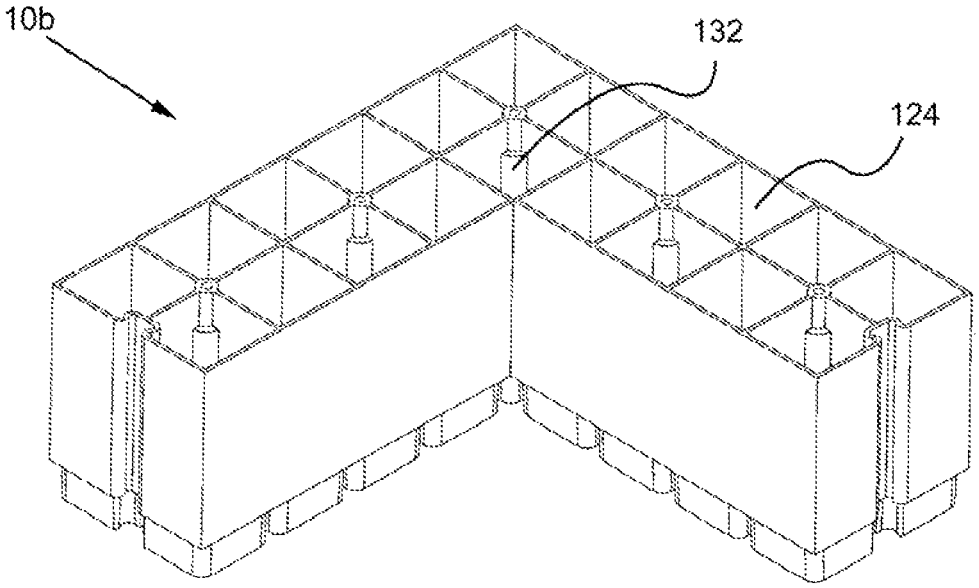
In FIG. 1*e*, a bottom view of the corner beginning brick is given.
Figure 2A:
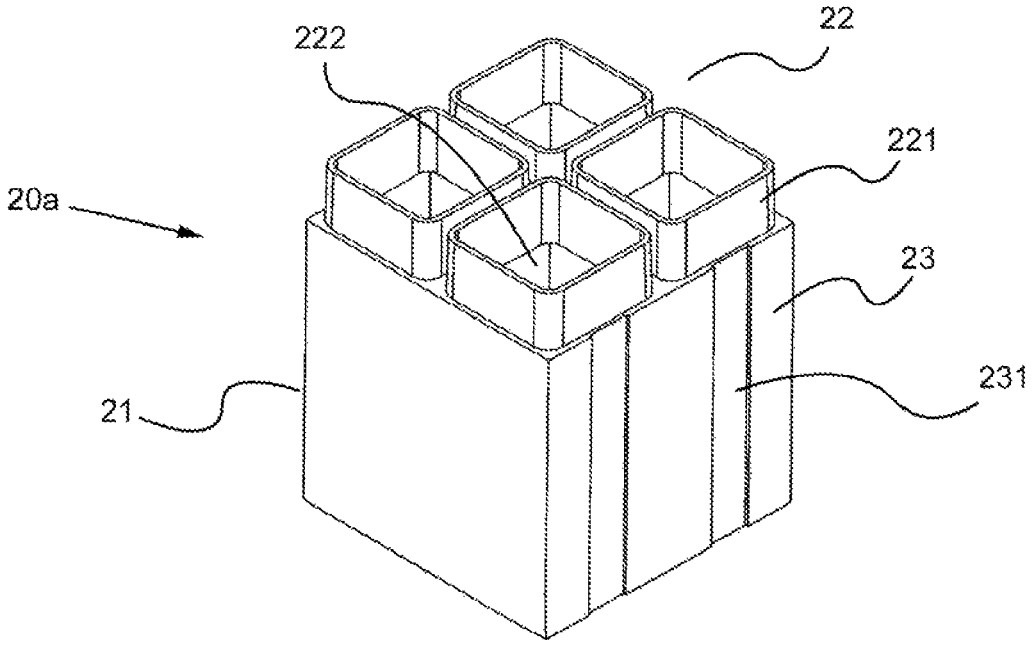
In FIG. 2*a*, a view of the flat wall brick is given.
Figure 2B:
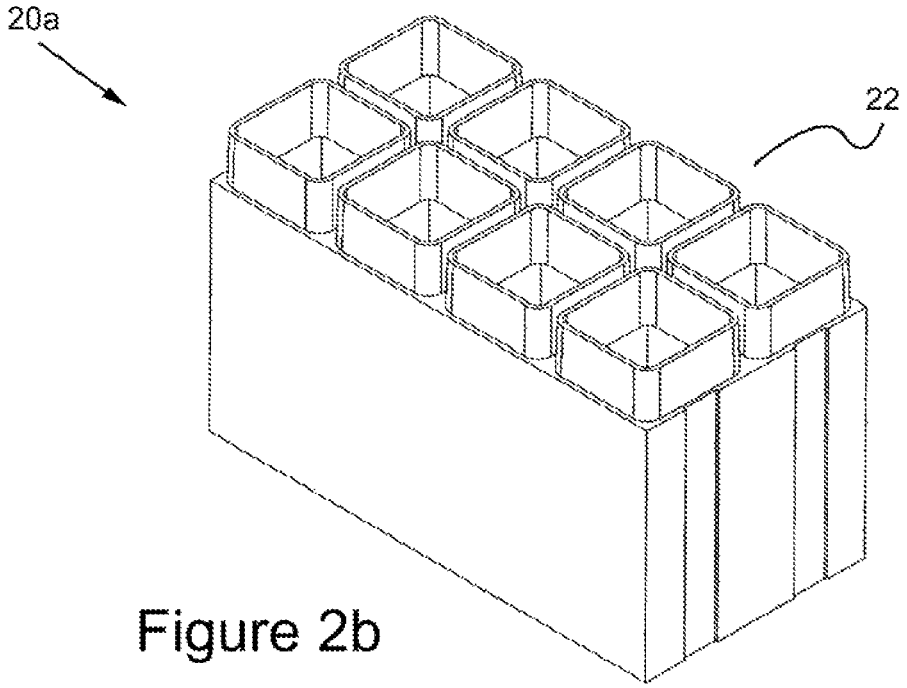
In FIG. 2*b*, another view of the flat wall brick is given.
Figure 2C:
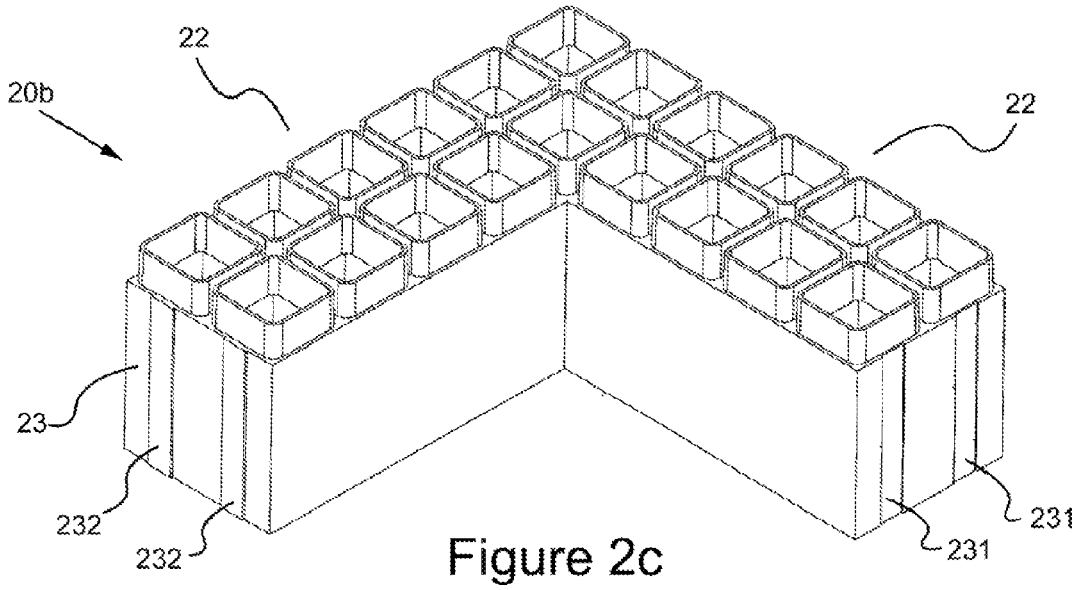
In FIG. 2*c*, a view of the corner wall brick is given.
Figure 2D:
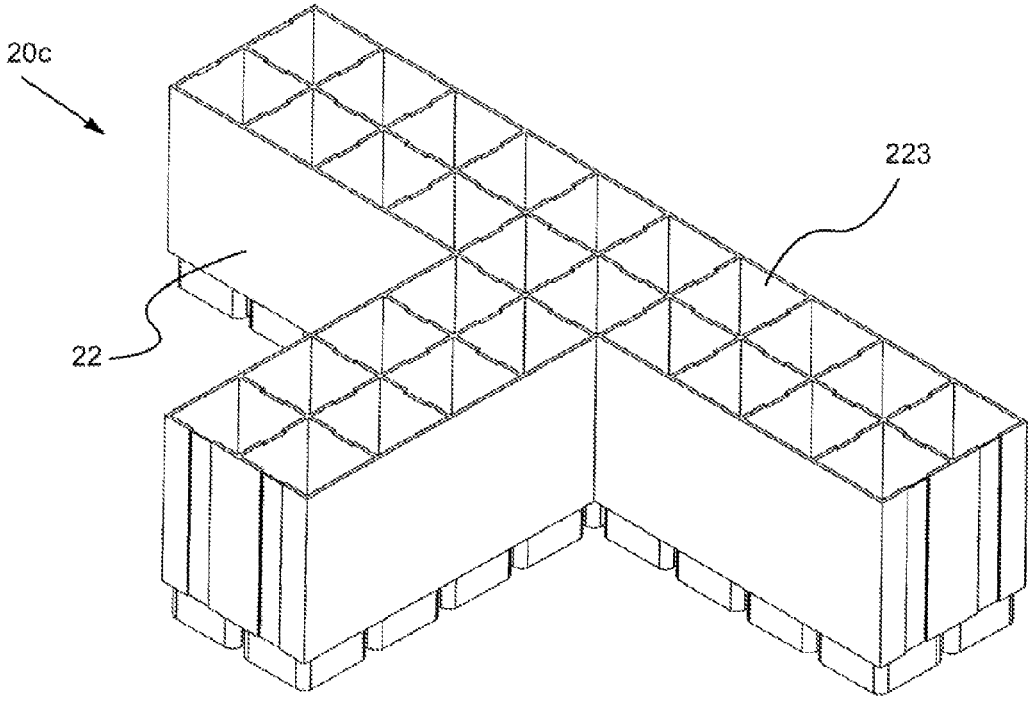
In FIG. 2*d*, a bottom view of the T wall brick is given.
Figure 2E:
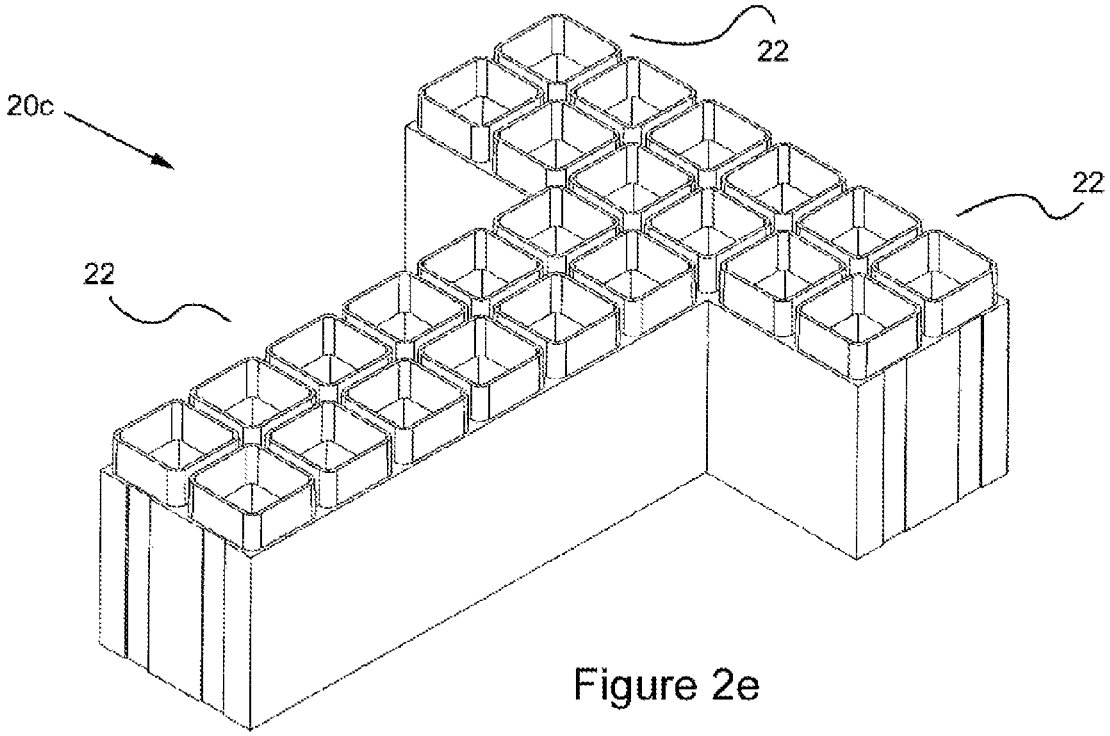
In FIG. 2*e*, a general view of the T wall brick is given.
Figure 2F:
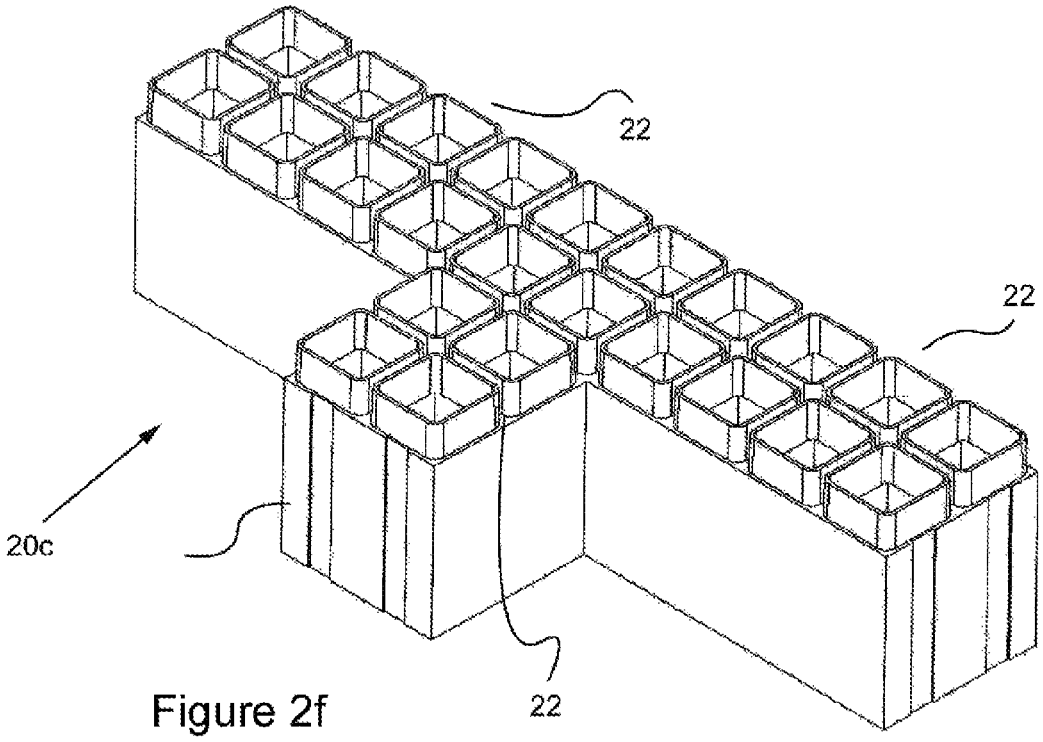
In FIG. 2*f*, a general view of another T wall brick is given.
Figure 3A:
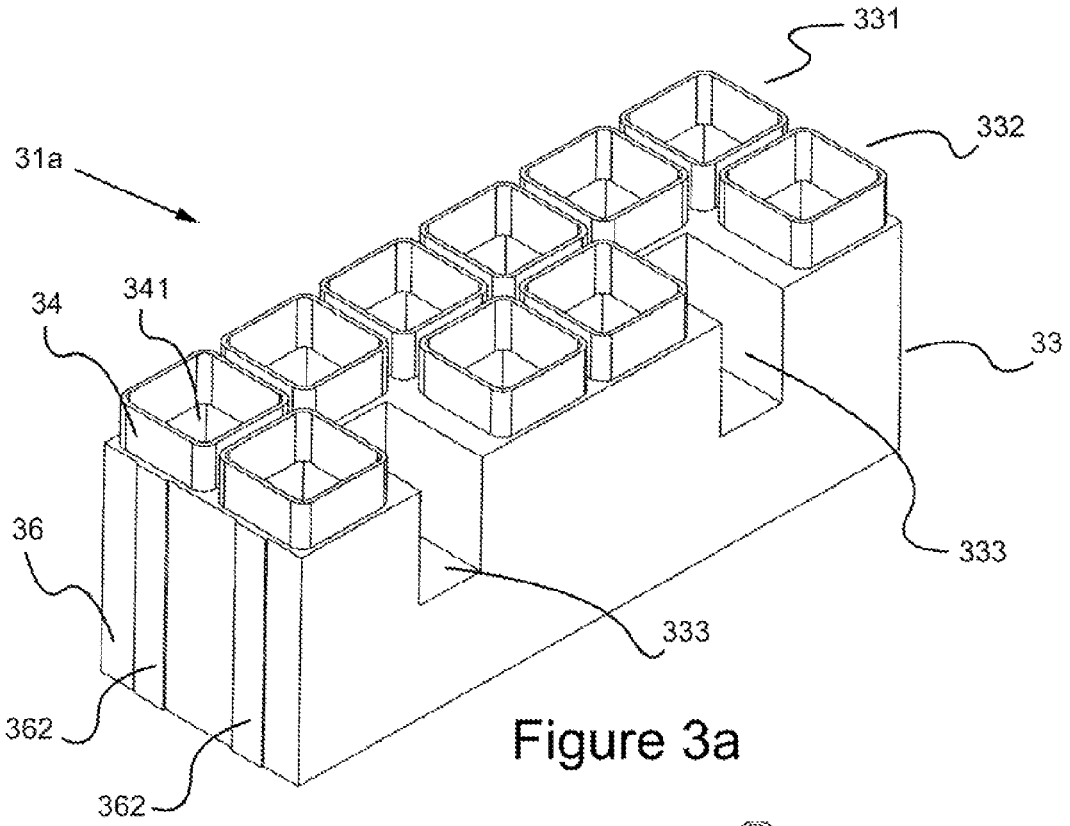
In FIG. 3*a*, a general view of the first bottom beam adaptor is given.
Figure 3B:
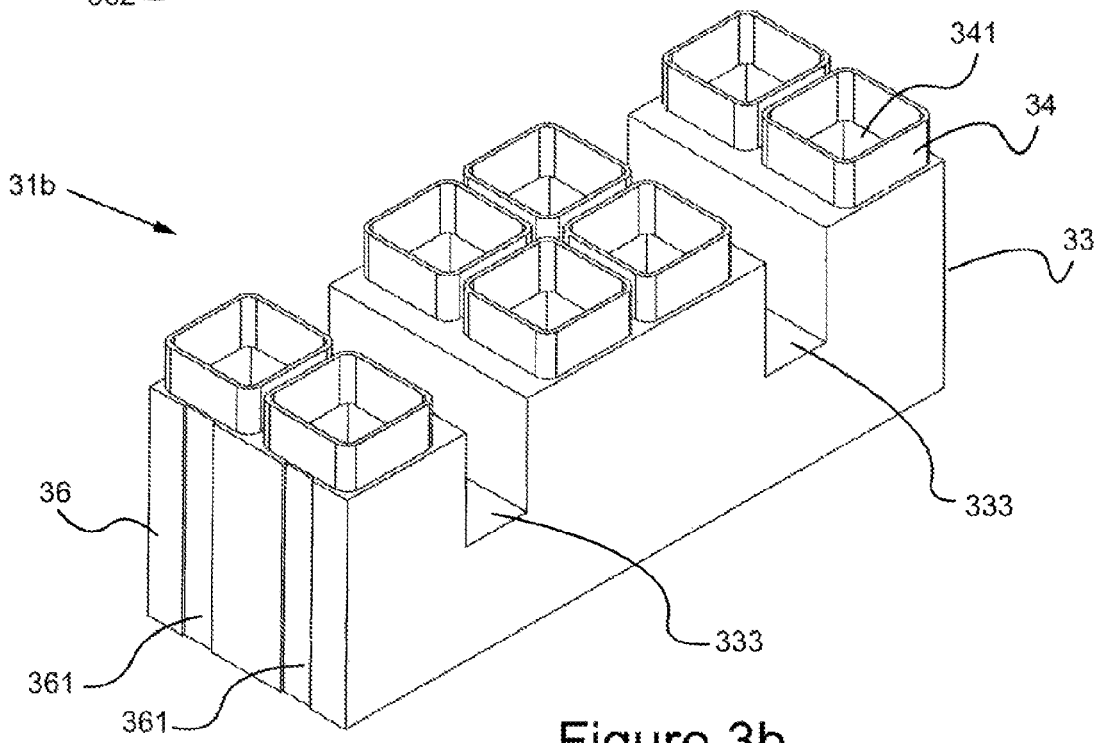
In FIG. 3*b*, a general view of the second bottom beam adaptor is given.
Figure 3C:
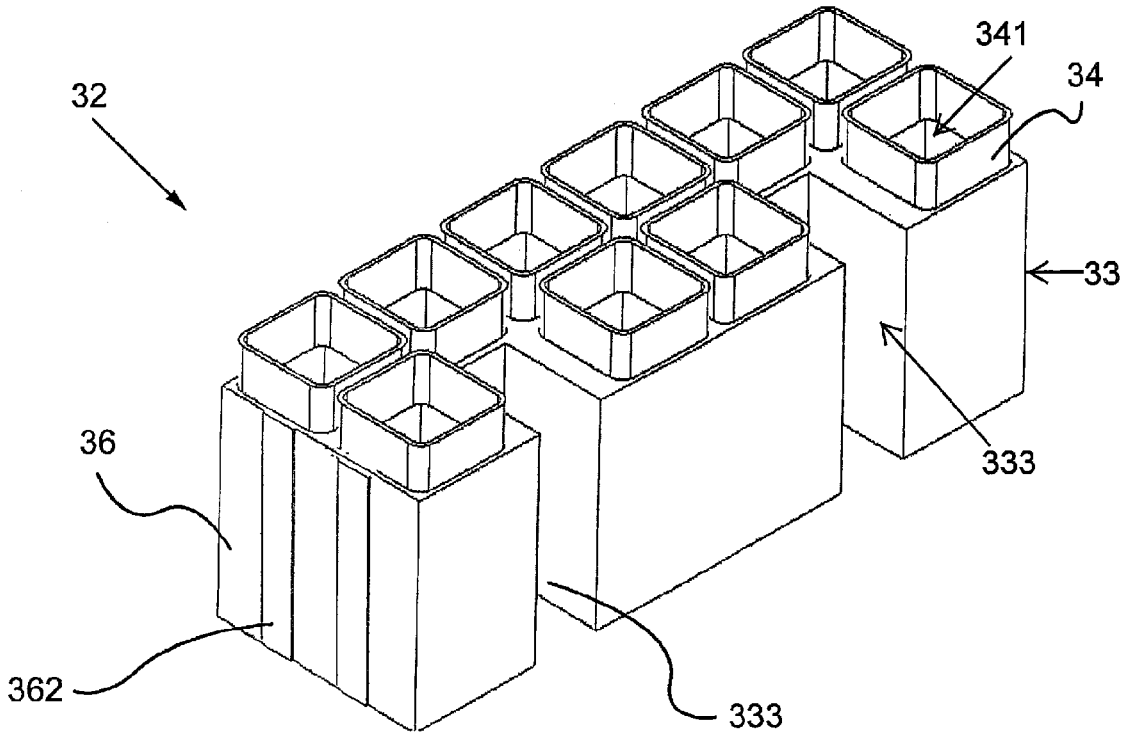
In FIG. 3*c*, a general view of the intermediate beam adaptor is given.
Figure 3D:
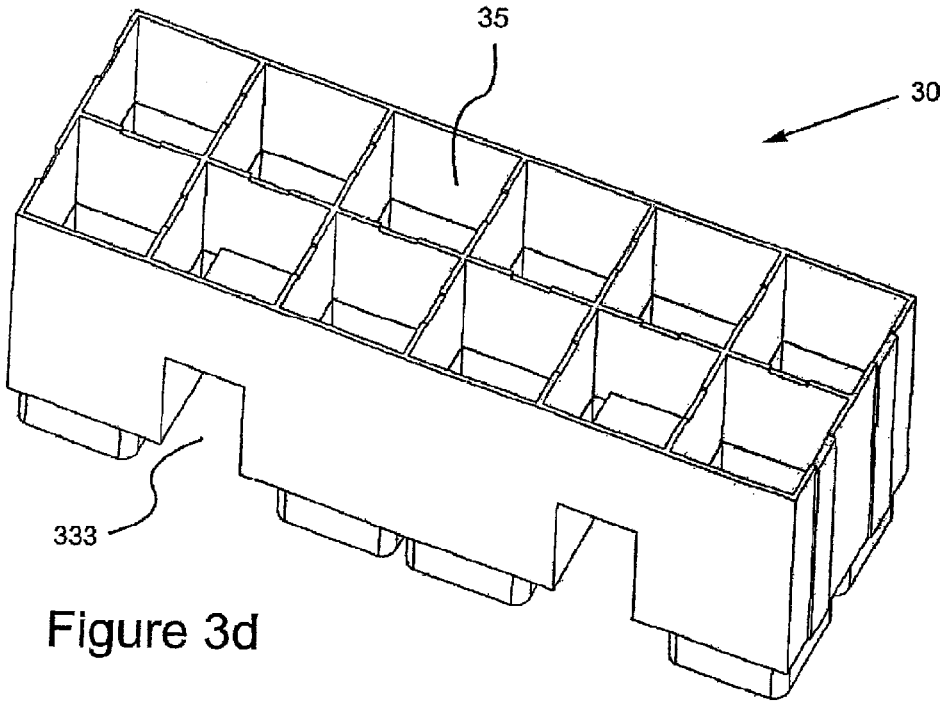
In FIG. 3*d*, a bottom view of the beam adaptor is given.
Figure 4A:
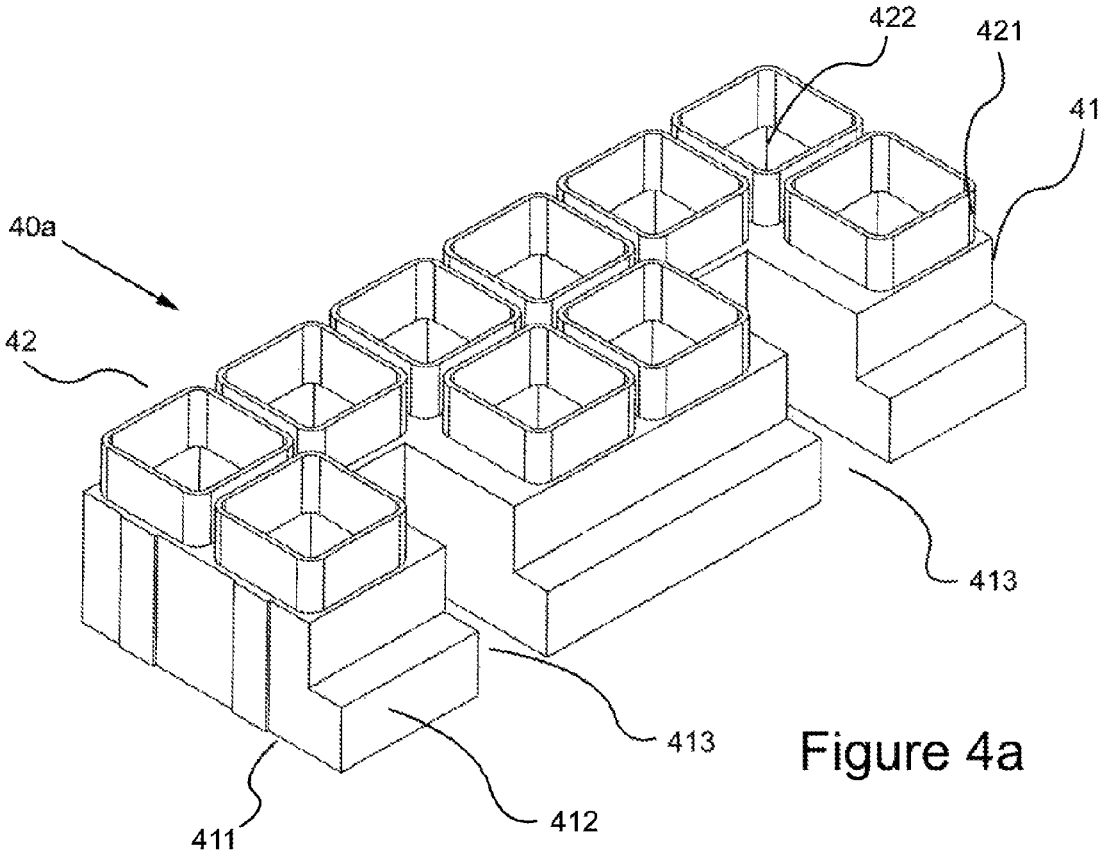
In FIG. 4*a*, a general view of the beam-type panel adaptor is given.
Figure 4B:
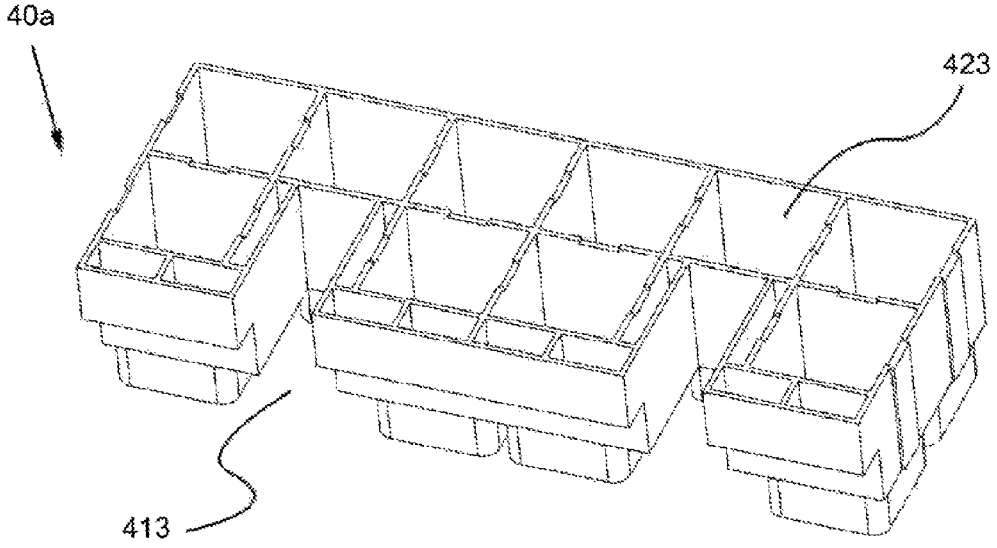
In FIG. 4*b*, a bottom view of the beam-type panel adaptor is given.
Figure 4C:
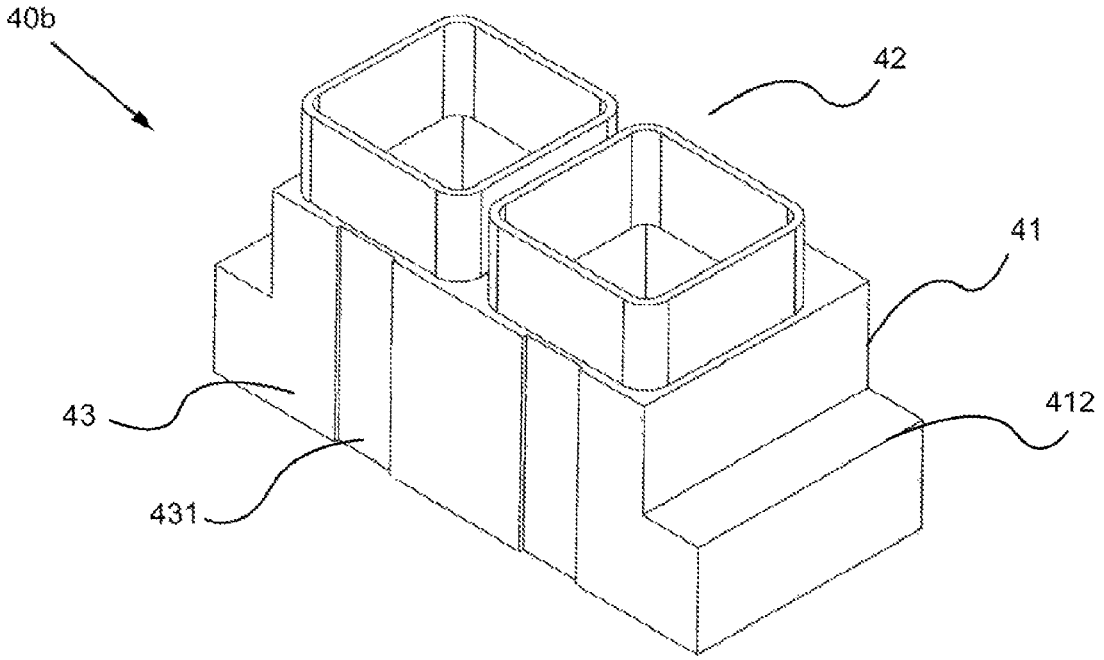
In FIG. 4*c*, a view of the flat panel adaptor is given.
Figure 4D:
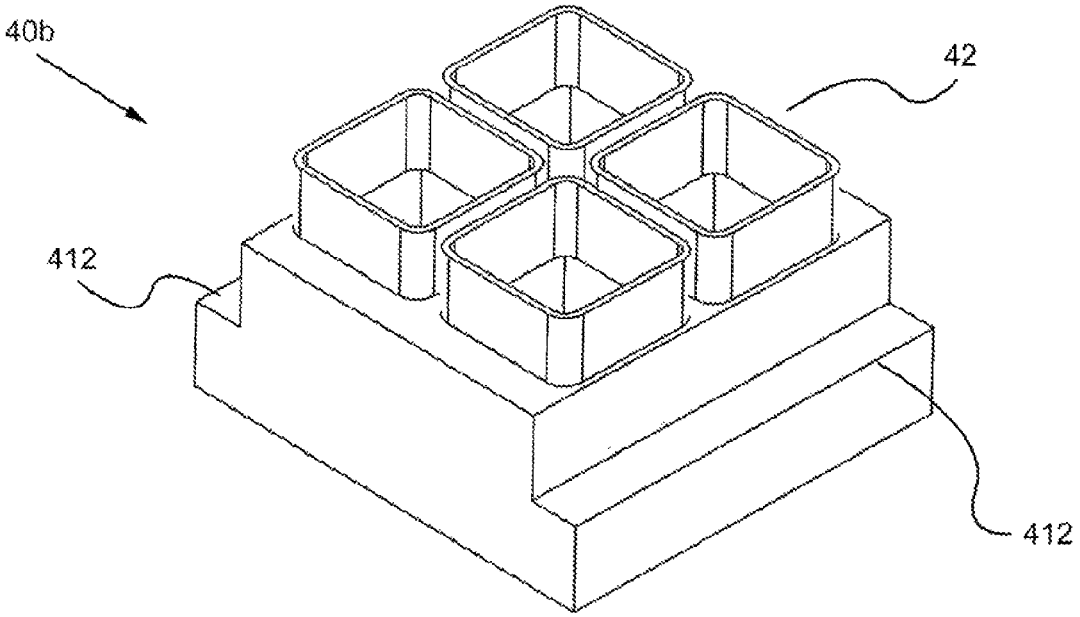
In FIG. 4*d*, a view of another flat panel adaptor is given.
Figure 4E:
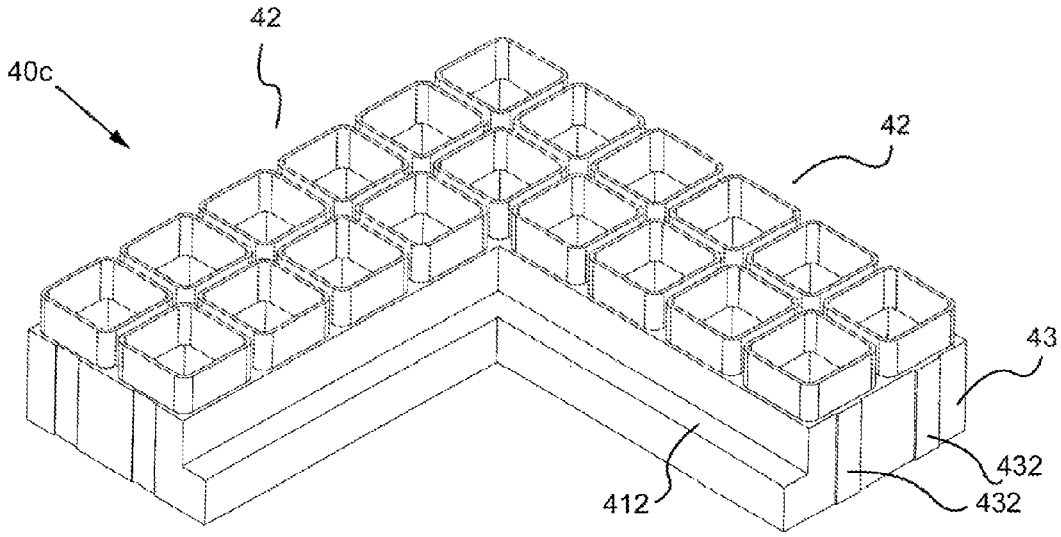
In FIG. 4*e*, a view of the corner panel adaptor is given.
Figure 4F:
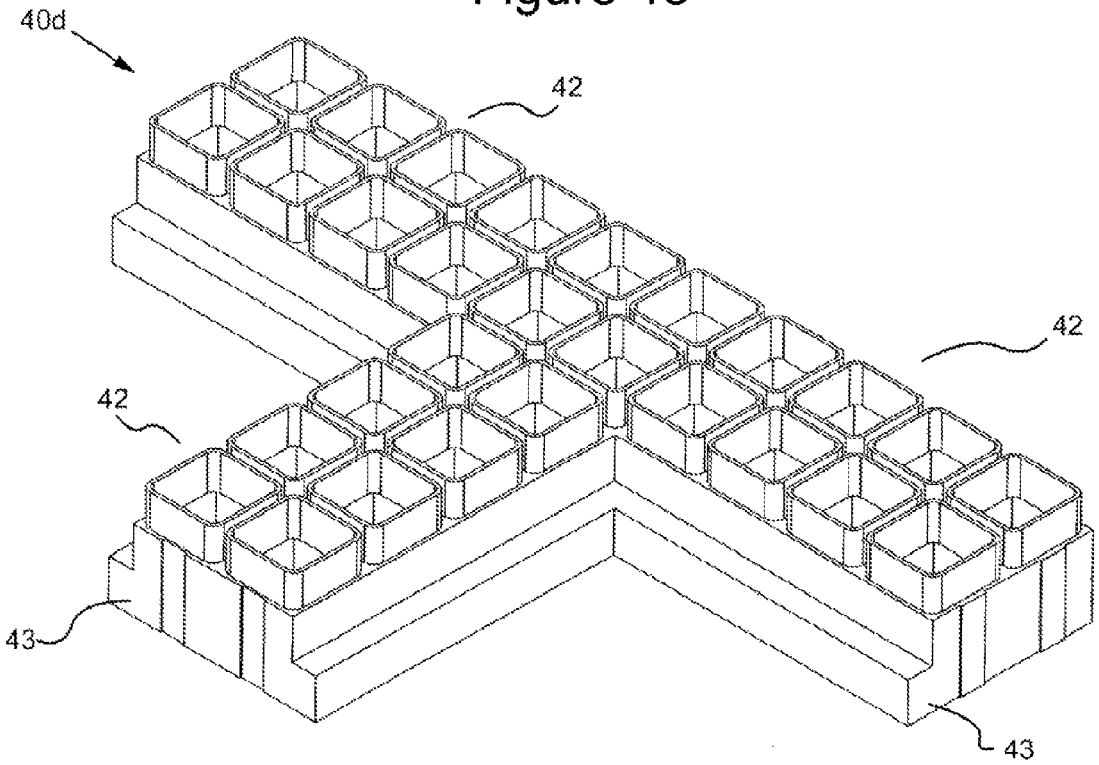
In FIG. 4*f*, a view of the T panel adaptor is given.
Figure 5:
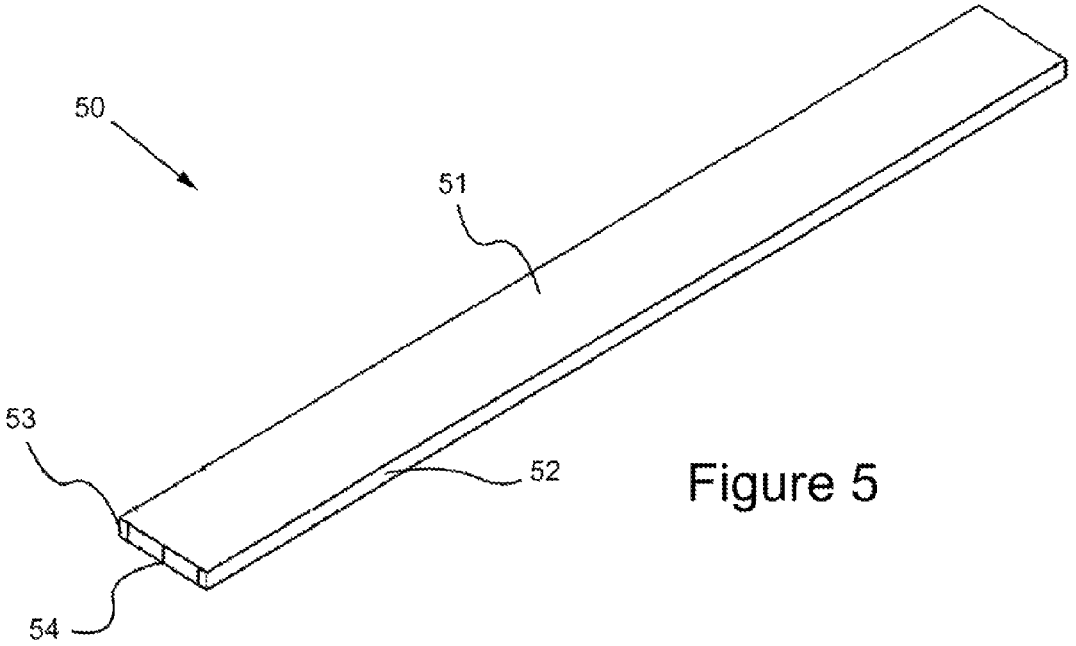
In FIG. 5, a general view of the beam is given.
Figure 6:
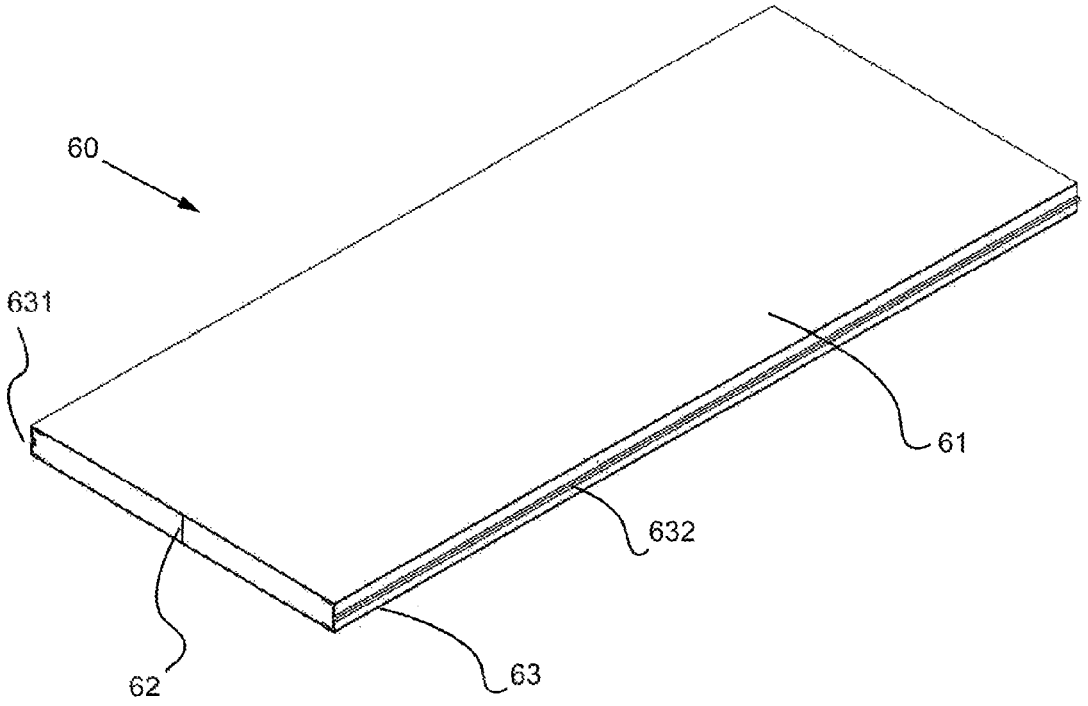
In FIG. 6, a general view of the panel is given.
Figure 7A:
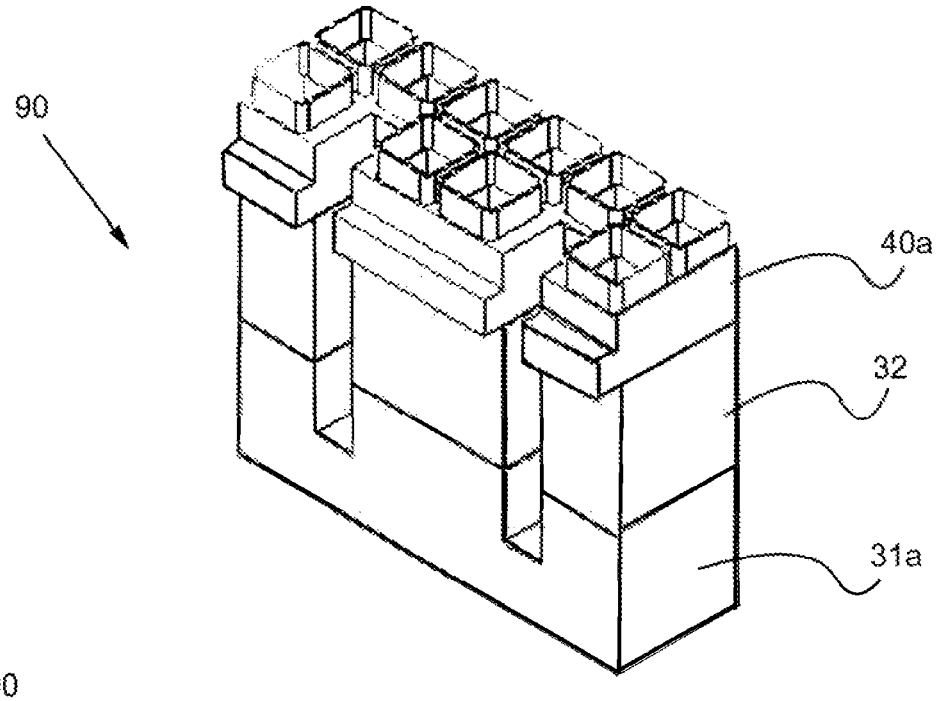
In FIGS. 7*a*, 7*b*, the views of the beam connection compartment are given.
Figure 7B:
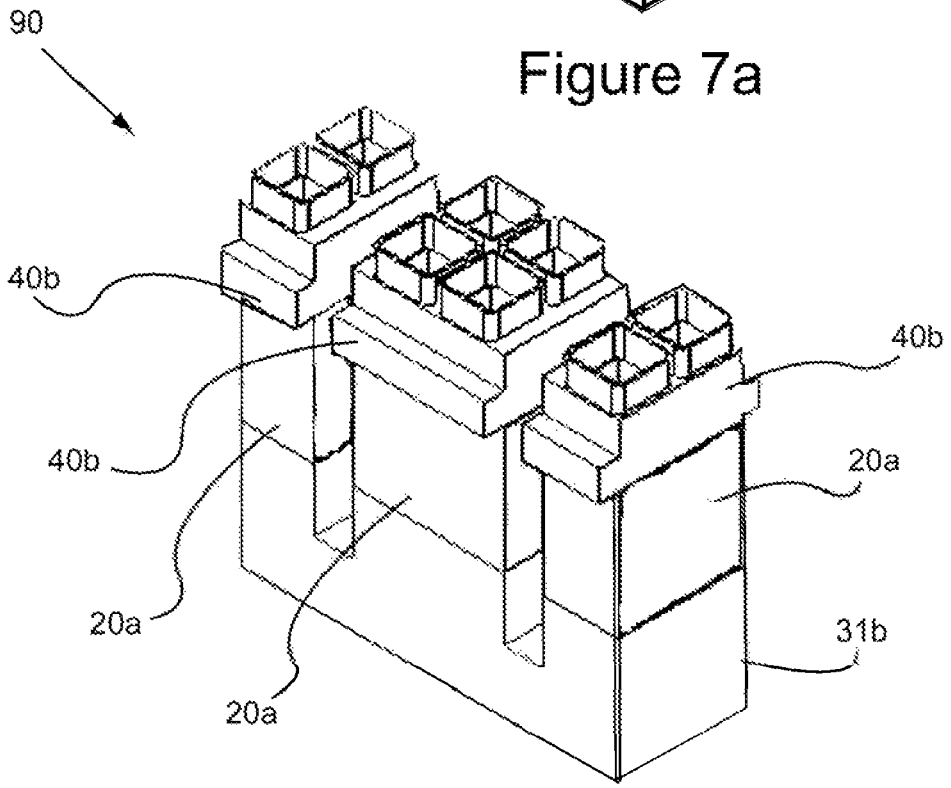
Figure 7C:
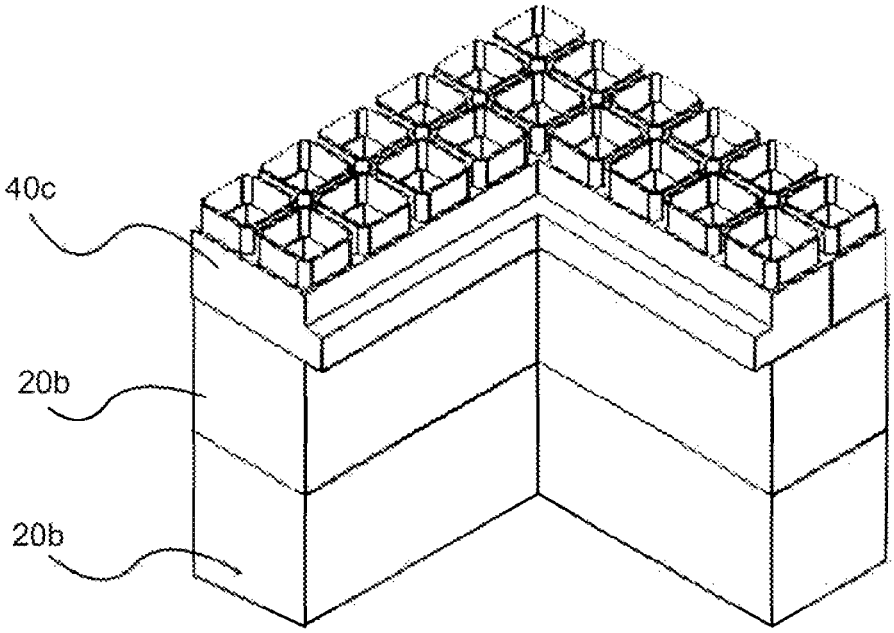
In FIGS. 7*c*, 7*d*, the views of the sections of the structure are given.
Figure 7D:
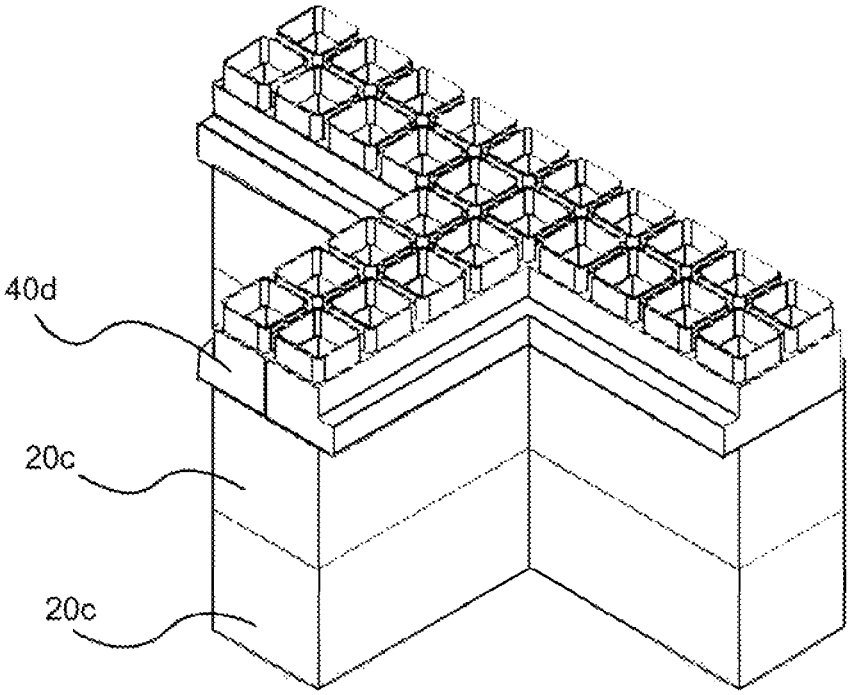
Figure 8A:
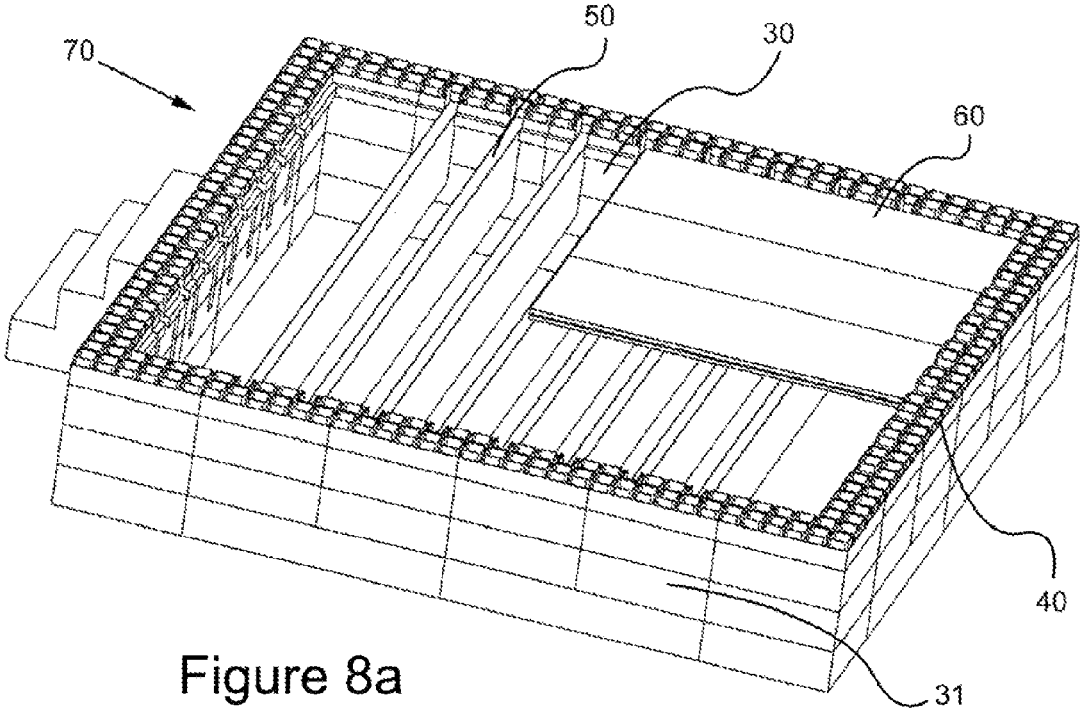
In FIGS. 8*a*, 8*b* and 8*c*, the views of the formation of the base are given.
Figure 8B:
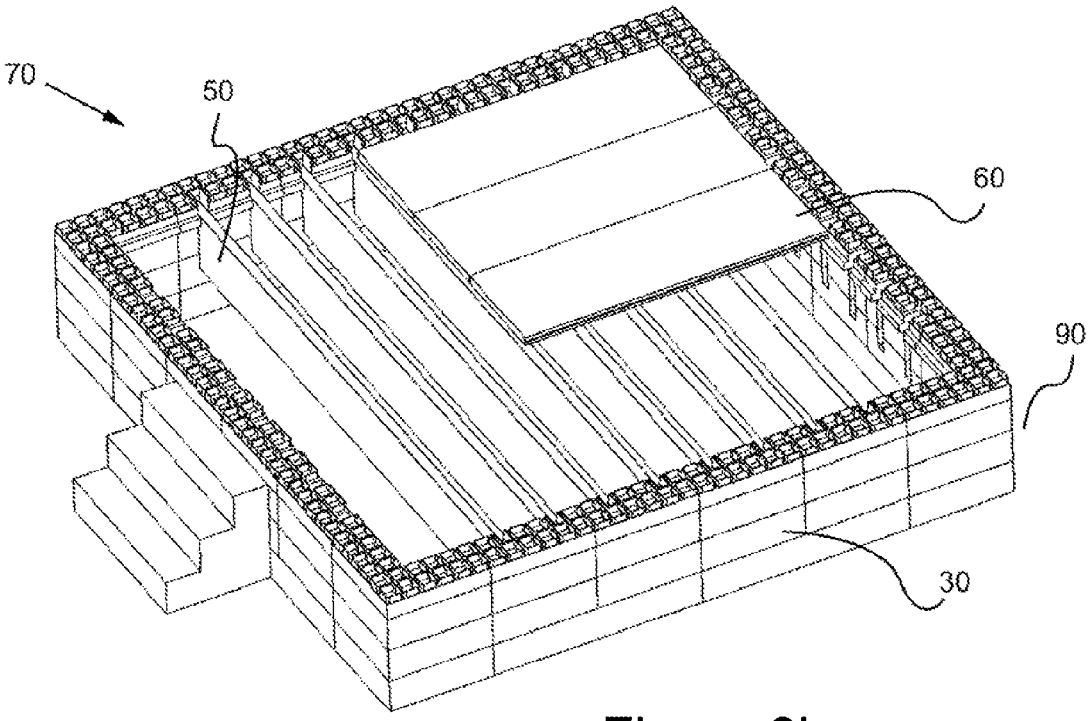
Figure 8C:
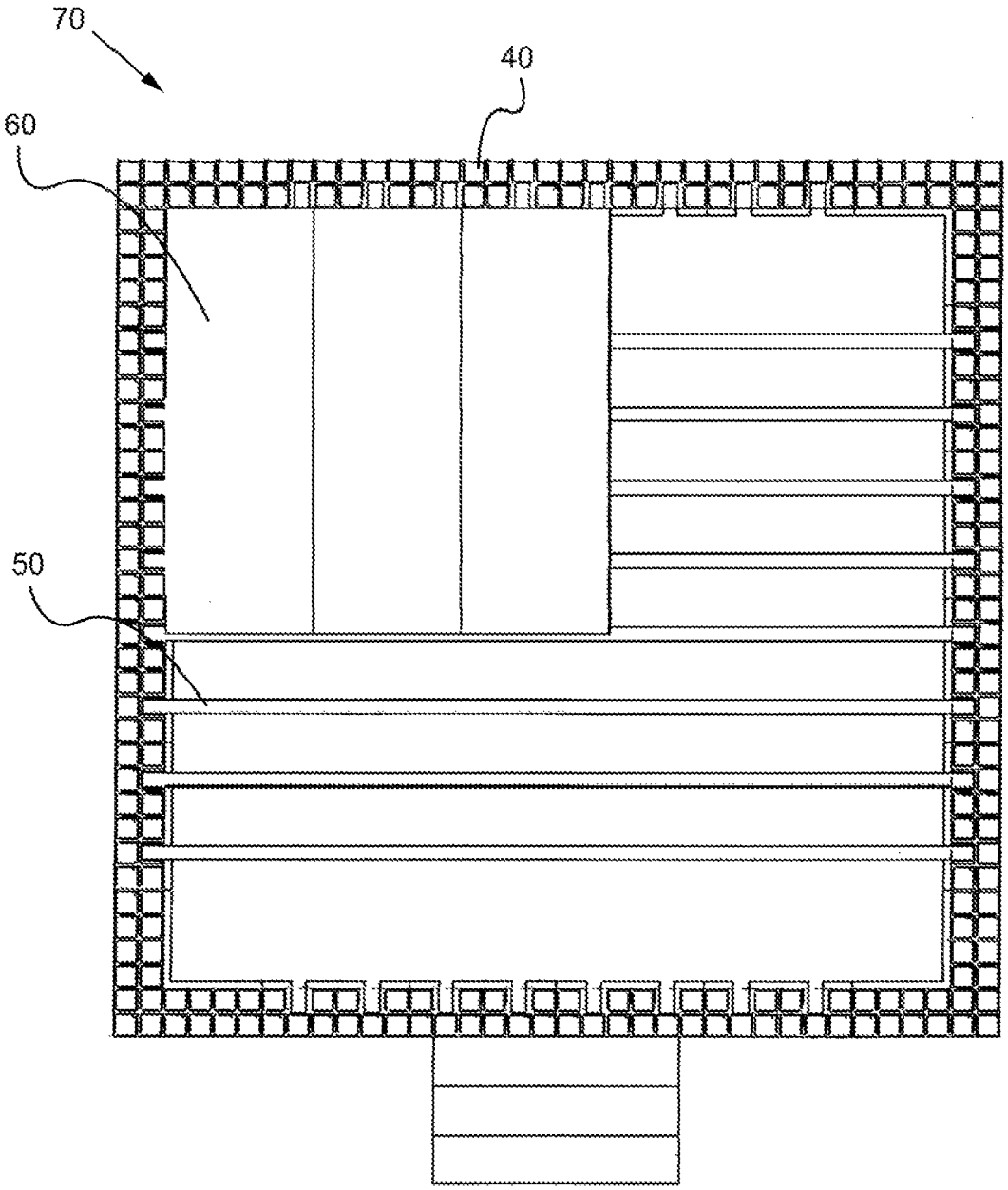
Figure 9:
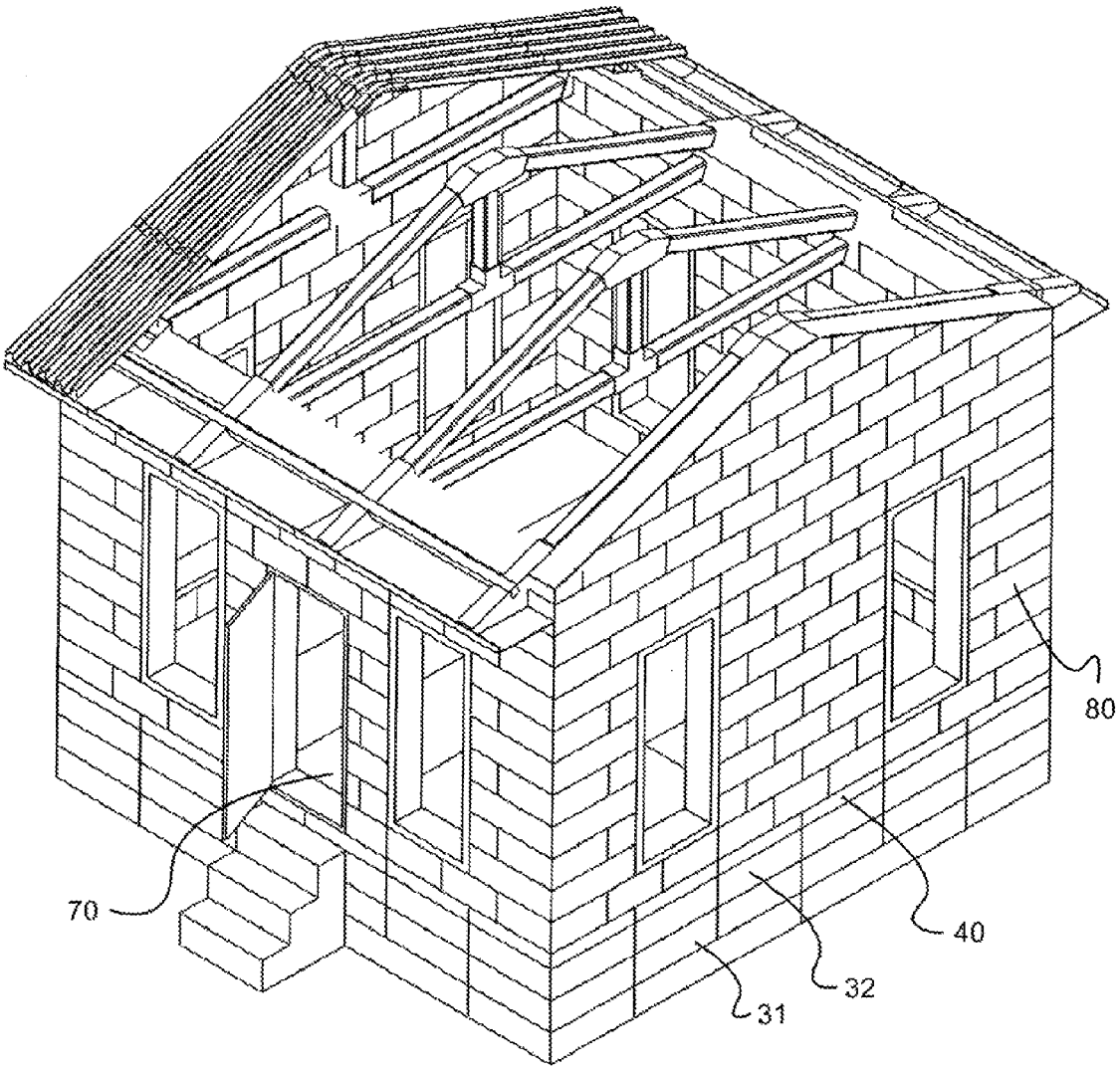
In FIG. 9, a general view of the one-floor structure is given.
Figure 10:
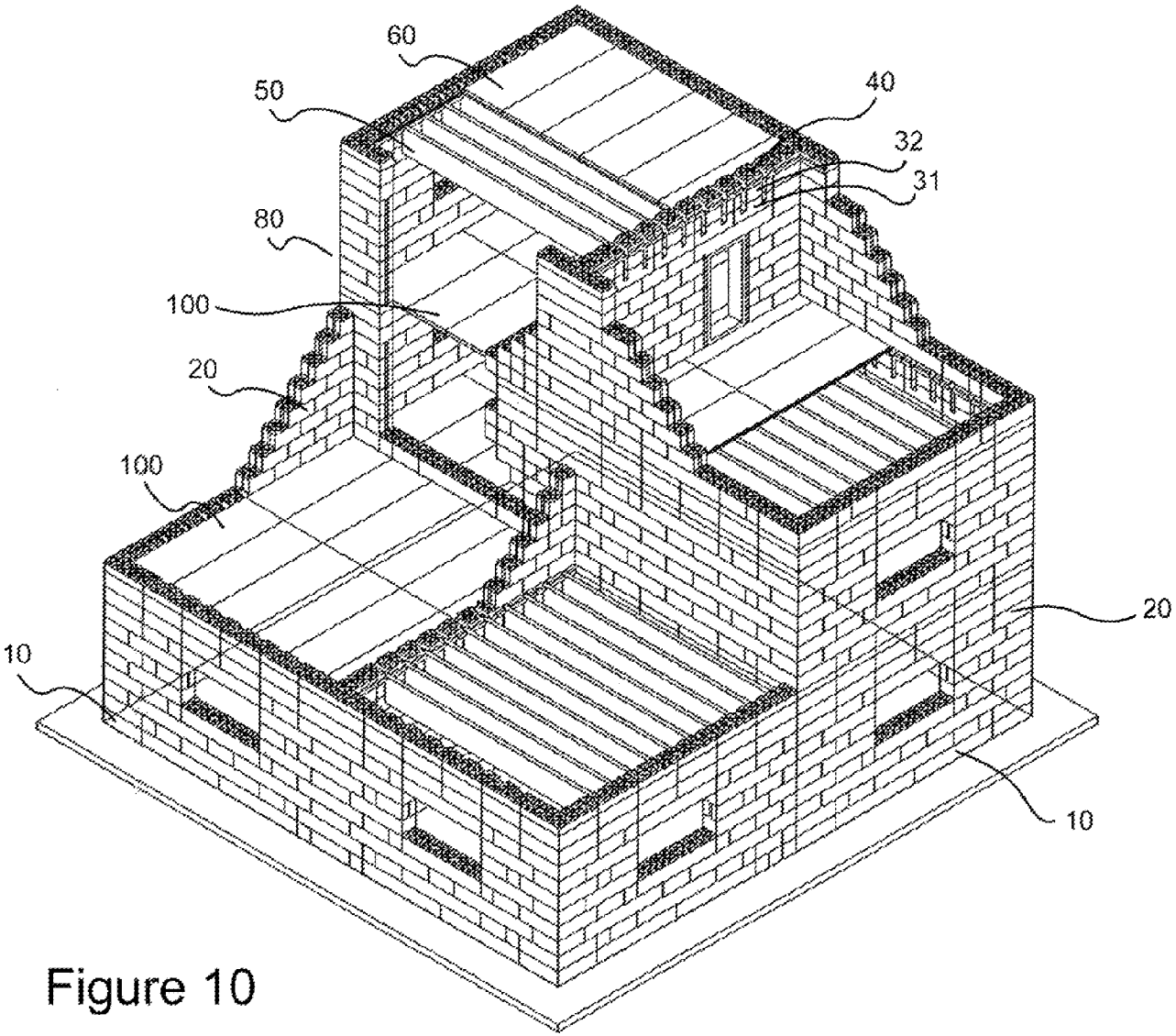
In FIG. 10, a view of the production of a multi-floor structure is given.

10 Beginning brick
10*a* Flat beginning brick
10*b* Corner beginning brick
10*c* T beginning brick
11 Beginning body
12 Wall connection section
121 First connection extension
122 First extension opening
123 Corner
124 First connection housing
13 Beginning brick lateral surface
131 Connection channel
132 Placement channel
14 Beginning body width section
20 Wall brick
20*a* Flat wall brick
20*b* Corner wall brick
20*c* T wall brick
21 Brick body
22 Wall connection section
221 Second connection extension
222 Second extension opening
223 Second connection housing
23 Wall brick lateral surface
231 Brick connection recess
232 Brick connection protrusion
30 Beam adaptor
31 Bottom beam adaptor
31*a* First bottom beam adaptor
31*b* Second bottom beam adaptor
32 Intermediate beam adaptor
33 Beam adaptor body
331 Flat section
332 Beam connection section
333 Beam housing
334 Beam adaptor width section
335 Beam adaptor length section
34 Third connection extension
341 Third extension opening
35 Third connection housing
36 Adaptor lateral surface
361 Adaptor connection recess
362 Adaptor connection protrusion
40 Panel adaptor
40*a* Beam type panel adaptor
40*b* Flat panel adaptor
40*c* Corner panel adaptor
40*d* T panel adaptor
41 Panel adaptor body
411 Base section
412 Panel connection section
413 Beam connection housing
42 Wall connection arm
421 Fourth connection extension
422 Fourth extension opening
423 Fourth opening housing
43 Panel adaptor lateral surface
431 Panel adaptor connection recess
432 Panel adaptor connection protrusion
44 Panel adaptor width section
45 Panel adaptor length section
50 Beam
51 Beam plate
52 Long edge
53 Support section
54 Beam rib
60 Panel
61 Panel plate
62 Panel rib
63 Panel lateral surface
631 Panel connection recess
632 Panel connection protrusion
70 Base
80 Wall
90 Beam connection compartment
100 Intermediate floor base

DETAILED DESCRIPTION

In this detailed description, the subject matter structure members are explained with references to examples without forming any restrictive effect in order to make the subject more understandable.

A beginning brick (10), used for forming the base (70), at least comprises a beginning body (11) which is at least in hollow box-like form, and a wall connection section (12) comprising at least two first connection extensions (121) at the beginning body width section (14) in a manner extending outwardly from the beginning body (11). At the intermediate section of the first connection extensions (121) provided such that there is a gap in between, the first extension opening (122) is provided, and it is in hollow box-like form. There are the first connection housings (124) at the bottom section of the beginning body (11). At least one connection channel (131) is provided having a cross section widening from outside towards inside on the beginning brick lateral surface (13) of the beginning brick (10) facing another beginning brick (10). Said connection channels (131) extend along the related first connection extension (121) and the bottom beginning body (11) preferably such that there is a step in between. The mutual connection channels (131) of the two beginning bricks (10) form a placement channel (132) such that at least one connection member is placed therein. A suitable connection member, preferably used for wedge-type connections, is placed to the placement channel (132). When desired, a more rigid connection can be realized by using two separate connection members corresponding to the sections of the placement channel (132) which are provided on the beginning body (11) and provided on the first connection extension (121) or by using a single connection member having height extending along said two sections. While the connection channel (131) is provided, the corners (123) of the first connection extensions (121) in the direction of the beginning brick lateral surface (13) are made into groove form. At a flat beginning brick (10*a*) having at least four first connection extensions (121) and where the wall connection section (12) extends in a flat manner, the corners (123) of the first connection extensions (121) facing the inner section are made into groove form, and a placement channel (132) is formed by extending into the beginning body (11). At the beginning body width section (14), there are flat beginning bricks (10*a*) having more than two first connection extensions (121) at the length section of the beginning body (11) such that two first connection extensions (121) are provided, and placement channel (132) is provided in the middle of each four first connection extension (121) at said flat beginning bricks (10*a*).

The corner beginning brick (10*b*) comprises wall connection sections (12) extending in an angled manner so as to have L-like cross section. The wall connection sections (12) extend horizontally in the form of two arms from two sides of the beginning body (11) in a manner that there is preferably essentially an angle of 90 degrees. In the T beginning brick (10*c*), the wall connection sections (12) extend in T form on the beginning body (11). The wall connection sections (12) of the T beginning bricks (10*c*) can be provided in various dimensions.

A wall brick (20) at least comprises a brick body (21) which is in hollow box-like form, and a wall connection section (22) comprising pluralities of second connection extensions (221) where at least two second connection extensions (221) are provided in the width section in a manner extending outwardly from above the brick body (21). The second extension opening (222) is provided in the intermediate section of the second connection extensions (221) provided such that a gap is provided in between, and it has a hollow box-like form. At the bottom section of the brick body (21), there are the second connection housings (223). There is the brick connection recess (231) or the brick connection protrusion (232) on at least one of the lateral surfaces (23) of the wall brick of the brick body (21) depending on the place where it will be used in the structure. In the preferred application, two each brick connection recesses (231) or the brick connection protrusions (232) are provided on the wall brick lateral surfaces (23). There is the flat wall brick (20*a*), the T wall brick (20*c*) and the corner wall brick (20*b*). The wall connection section (22) of the flat wall brick (20*a*) extends in a flat manner. In the preferred application, flat wall bricks (20*a*) are provided having pluralities of second connection extensions (221) in the length section such that there are two second connection extensions (221) in the width section of the brick body (21). The corner wall brick (20*b*) comprises wall connection sections (22) extending in an angled manner so as to have an L-like cross section. The wall connection sections (22) extend in the horizontal plane in the form of two arms from two sides of the brick body (21) such that there is an angle of preferably essentially 90 degrees. In the T wall brick (20*c*), the wall connection sections (22) extend on the brick body (21) in T form. The wall connection sections (22) of the T wall bricks (20*c*) and of the corner wall bricks (20*b*) can be provided in pluralities of dimensions.

A beam adaptor (30) is embodied in a form which is similar to the flat wall brick (20*a*). A beam adaptor body (33), which is at least in hollow box like form, comprises pluralities of third connection extensions (34) provided such that there are two third connection extensions (34) in the beam adaptor width section (334) in a manner extending outwardly from above the beam adaptor body (33). In the intermediate section of the third connection extensions (34) provided such that there is a gap in between, the third extension opening (341) is provided, and it has a hollow box like form. There are the third connection housings (35) at the bottom section of the beam adaptor body (33). There is the adaptor connection recess (361) or there is the adaptor connection protrusion (362) in at least one of the adaptor lateral surfaces (36) of the beam adaptor body (33) depending on the place where it will be used in the structure. In the preferred application, two adaptor connection recesses (361) or two adaptor connection protrusions (362) are provided such that there is a certain distance in between on the adaptor lateral surface (36). The beam adaptor (30) comprises a flat section (331) and a beam connection section (332) so as to be integrated to each other. In the beam connection section (332) of the bottom beam adaptor (31), there is the beam housing (333) at least between the two third connection extensions (34) and at least along a section of the height of the beam adaptor body (33). In the first bottom beam adaptor (31*a*), some of the third connection extensions (34), provided in the beam connection section (332), are eliminated, and the beam housing (333) is provided at a section of the height of the beam adaptor body (33) in the vertical direction of the eliminated third connection extensions (34). In the second bottom beam adaptor (31*b*), the beam housing (333) is provided between the third connection extensions (34) by beginning from a section of the height of the beam adaptor body (33) and along the width of the beam adaptor body (33). In the intermediate beam adaptor (32), the beam housing (333) is formed by eliminating some of the third connection extensions (34) in the beam connection section (332) such that the beam housing (333) completely covers the height of the beam connection section (332).

The panel adaptors (40) essentially comprise a panel adaptor body (41), and a wall connection arm (42) comprising pluralities of fourth connection extensions (421) provided such that there are two fourth connection extensions (421) in the panel adaptor width section (44) in a manner extending outwardly from above the panel adaptor body (41). In the intermediate section of the fourth connection extensions (421) provided such that there is a gap in between, the fourth extension opening (422) is provided, and it has a hollow box-like form. At the bottom section of the panel adaptor body (41), there are the fourth connection housings (423). The panel connection section (412) extends horizontally outwardly from the base section (411) of the panel adaptor body (41). On the intermediate walls (80) of the structure, the panel connection section (412) extends towards two sides mutually from the base section (411). Moreover, the panel connection sections (412) can extend from one side of the panel adaptor body (41) for the ends of the wall (80). Depending on the place where it will be used in the structure, on at least one of the panel adaptor lateral surfaces (43) of the panel adaptor body (41), there is the panel adaptor connection recess (431) or the panel adaptor connection protrusion (432). In the preferred application, two panel adaptor connection recesses (431) or two panel adaptor connection protrusions (432) are provided on the panel adaptor lateral surface (43) such that there is a certain distance in between. In the beam type panel adaptor (40*a*), at least one beam connection housing (413) is provided between the fourth connection extensions (421) which are provided on the side, where the panel connection section (412) is provided, from the row of the two fourth connection extensions (421) provided in the panel adaptor width section (44). There is the flat panel adaptor (40*b*), the T panel adaptor (40*d*) and the corner panel adaptor (40*c*). The wall connection arm (42) of the flat panel adaptor (40*b*) extends in a flat manner. The corner panel adaptor (40*c*) comprises wall connection arms (42) extending in an angled manner so as to have an L-like cross section. The wall connection arms (42) extend horizontally in the form of two arms from two sides of the panel adaptor body (41) such that there is preferably essentially an angle of 90 degrees. The panel connection arms (42) in the T panel adaptor (40*d*) extend in T form on the panel adaptor body (41). The wall connection arms (42) of the T panel adaptors (40*d*) and of the corner panel adaptors (40*c*) can be provided in various dimensions.

The beam (50) is formed by mutually positioning two beam plates (51) which are in composite structure, and it is embodied in a rectangular prism like form. A section having predetermined width inwards the long edge (52) thereof forms the support section (53) so as to be made of the material forming the beam plate (51). A beam rib (54) is provided extending longitudinally in the inner section of the beam (50). The hollow sections inside the beam (50) can be left in this manner, or they may be filled with foam.

The panel (60) is formed by mutually positioning two panel plates (61) which are in composite structure, and it is embodied in a rectangular prism-like form. The inner section of the panel (60) is filled with styrofoam material. At the inner section of the panel (60), a panel rib (62) extending longitudinally is provided. At least one panel connection protrusion (632) or at least one panel connection recess (631) is provided extending in at least one of the panel lateral surfaces (63). The panel connection recess (631) and the panel connection protrusion (632) can be provided along the panel lateral surface (63) or along a section of the panel lateral surface (63). In the preferred application, it extends along the panel lateral surface (63).

As can be seen from the abovementioned description, the bodies of the related structure members comprise one of at least one first extension opening (122), second extension opening (222), third extension opening (341), fourth extension opening (422) extending along the length of the body height, and preferably, it has a form like a box with or without compartment. This form increases the resistance of the related structure members, and at the same time it provides thermal and noise insulation with the outer environment without the need for an additional insulation means. Moreover, the items like electricity cables, telephone cables or other cables are passed through these openings of a structure, and this is an advantage substantially accelerating the construction process.

The base (70) formation process realized by means of the structure members, whose structural details are given above, is given below. First of all, the basic lines of the structure on the base are formed by means of the flat beginning bricks (10*a*), the corner beginning bricks (10*b*) and the T beginning bricks (10*c*) after laying the base. Flat beginning bricks (10*a*) are arranged in the sections where a flat wall (80) is to be formed. The flat beginning bricks (10*a*) are connected and fixed to the base by placing a connection member to the placement channels (132); and they are connected to each other by means of placement of the connection member to the placement channel (132) formed by means of mutually positioning of the connection channels (131) provided on the beginning brick lateral surfaces (13). Meanwhile, the flat beginning brick (10*a*) is connected to the base by means of the connection member placed to the placement channel (132). In conditions where compartment is realized like the room compartment, in other words, in the section where the three walls (80) are to be joined, T beginning brick (10*c*) is used, and in the condition where corner will be formed, the corner beginning brick (10*b*) is used. In order for providing placement of the beams (50), beam connection compartment (90) is formed on the mutual flat beginning bricks (10*a*). In the formation of the beam connection compartment (90), first of all, the bottom beam adaptor (31) is placed on the beginning brick (10). When beam connection compartment (90) is desired to be formed at the end of the wall (80) of the structure, the first bottom beam adaptor (31*a*) is used. The intermediate beam adaptor (32) is seated thereon. The third connection extensions (34) of the first bottom beam adaptor (31*a*) are inserted into the third connection housings (35) of the intermediate beam adaptor (32). The intermediate beam adaptor (32) is connected to the wall brick (20) provided next to it or to another intermediate beam adaptor (32) by means of insertion of the adaptor connection protrusion (362), provided on the adaptor lateral surface (36), into the adaptor connection recess (361) of the intermediate beam adaptor (32) or of the wall brick (20) provided next to it. In the completely opposite case, there may be a connection recess on the intermediate beam adaptor (32). The panel adaptor (40) is placed on the top. The third connection extensions (34) of the intermediate beam adaptor (32) are placed to the fourth connection housings (423) of the panel adaptor (40), and the connection process is realized. If the beam connection compartment (90) is formed on the intermediate walls (80) inside the structure, first of all, the second bottom beam adaptor (31*b*) is placed on the beginning brick (10). Flat wall bricks (20*a*) are placed on the second bottom beam adaptor (31*b*) such that the beam connection sections (332) are free. There is no connection member on the wall brick lateral surfaces (23) of the flat wall bricks (20*a*) facing each other. On the wall brick lateral surfaces (23) of the two flat wall bricks (20*a*), provided on the outer face placed on the second bottom beam adaptor (31*b*), not facing the beam (50), there is the brick connection recess (231) or the brick connection protrusion (232) in order to be connected to another wall brick (20). By means of this, it is connected to the wall brick (20) provided next to it. As described, after beam connection compartments (90) are formed in the determined sections of the structure, the beams (50) are placed so as to be placed to the beam connection sections (332). At the ends of the wall (80), the beams (50) are seated to the beam connection sections (332), and they are ended. At the intermediate walls (80), they are seated to the beam connection section (332), and they continue to extend towards the other compartment of the structure. The distances between the beams (50) change depending on the area opening provided inside the structure. After the placement of the beams (50) is completed, the panels (60) are placed into the structure. The panels (60) are seated to the panel connection section (412) of the panel adaptors (40), and they are adhered by means of a predetermined adhesive. The panels (60) are connected to each other by means of placement of another panel adaptor connection protrusion (432) into the panel adaptor connection recesses (431). The beams (50) provide power to the panels (60), and thus the depression of the panels (60) is prevented. Since there is styrofoam material inside the panels (60), the panels (60) are light, and the noise insulations thereof are strengthened. By means of this, the base (70) of the structure is completed.

After the base (70) is formed for single-floor structures as described above, flat wall bricks (20*a*), corner wall bricks (20*b*) and T wall bricks (20*c*) are suitably placed on the panel adaptors (40). In order to form the corners, corner wall bricks (20*b*) are used, and in order to form the compartments like rooms, T wall bricks (20*c*) are used. After wall (80) with the desired height is formed, the ceiling and the roof sections are formed.

Concrete base is used in multi-floor structures. Beginning bricks (10) are connected to the concrete base in order to begin formation of composite multi-floor structure, and afterwards, walls (80) are formed by means of the wall bricks (20). A floor is obtained, and intermediate floor bases (100) and the other floors are embodied thereon. The intermediate floor bases (100) are formed in a form similar to a base (70). By means of forming beam connection compartments (90), the beams (50) are placed, and finally the panels (60) are placed, and the intermediate floor base (100) is formed. In the same manner, the ceiling of the top floor can be formed, or it may be left as a terrace.

All structure members used in the present invention are made of a material based on SMC (sheet molding composites), and they are produced by means of a production method known in this field. Accordingly, in a compliant manner to the hot pressing production, some structure members provided in the present invention may comprise two pieces, which are symmetrical with respect to each other, forming the structure member when joined.

Accordingly, in a preferred formulation, in order to provide resistance, the subject matter structure member is made of composite material comprising at least one type of fiber at a proportion of 25-33%, at least one type of mineral powder as filling material at a proportion of 40-50%, at least one type of resin at a proportion of 20-25% as binding member between the fiber and filling material, and at least one chemical additive at a proportion of 5-8%. The resin described in said invention is thermoset resin.

ST steel values are determined depending on the resistance requirement in the structure. Depending on the determined ST value, a resin can be selected from the group of vinyl ester resin and isophthalic resin. Moreover, a fiber can be selected from the carbon fiber, glass fiber and aramid fiber group. The desired ST steel value is reached by forming resin and fiber combinations. It is preferred that vinyl ester resin is used as resin, and carbon fiber is used as fiber, in order to obtain a material having relatively high resistance and particularly in order to obtain a material with ST 52 steel values. In the sections where there is no high resistance requirement, isophthalic resin is used as the resin and glass fiber is used as the fiber in order to obtain a material having relatively low resistance and particularly in order to obtain a material with the values of ST 37 steel. In the structure members where intermediate level of resistance is needed, isophthalic resin is preferred as the resin, and aramid fiber is preferred as the fiber, and thus, a material with ST 42 steel values can be obtained. In order to reach ST values except the abovementioned values depending on the particular requirements, isophthalic resin and carbon fiber are used, and it may be preferred that vinyl ester resin and glass giber are used together. Preferably, the wall thickness of the subject matter structure members can be between 4 mm and 2 cm depending on the desired resistance.

In the present invention, the resin, provided in the composite material produced by means of the SMC method, is thermoset resin, and thus, the density of the composite material increases up to 3 grams/cm$^3$. The density of the composite material becomes compliant to the mineral powder used in the composite material, and filling material can be added to the material at a proportion of 40-50%. Thanks to said compliancy, all of the mechanical resistances have increased, and since filling material, whose cost is lower when compared to resin and fiber, can be used at a higher proportion, the cost of the structure can also be decreased. Since the filling material can be used at a high proportion, the water resistance, temperature resistance, rigidity, surface smoothness and acid resistance of the structure also increase. The filling material cannot be added to every material at a high proportion as in the composite material. For instance, high density PE and similar plastic materials, where injection molding is realized, have lower density when compared to composite materials where SMC method is used. Therefore, the addition of filling materials to the YYPE material at high proportion is prevented. Because of the incompliancy which may occur between YYPE and the mineral powder which can be added to said composite material at a proportion of 40-50%, the mineral powder cannot be added to the YYPE material. In details, the density of YYPE is approximately 1 gram/cm$^3$, and it is very difficult to add mineral powder therein having density up to 3 grams/cm$^3$. Different densities lead to incompliancy between mineral powder and YYPE, and the properties like tensile strength decrease substantially so as to lead to usage of unsuitable structure members in structures.

On the other hand, as the filling material, at least one type of mineral powder which is selected from a mineral group comprising silisium dioxide, barite, talc and calcite as the filling material is used; and as the inorganic chemical additive, at least one of the chemicals increasing water absorption and resistance against flame are used. In addition to these, said formulation moreover can comprise predetermined amount of thermoplastic material in order to improve surface appearance.

As known, the forces, which a structure is subject to, can be classified in 5 topics like the tensile forces, pressure forces, momentum forces, cutting forces and tore. A structure can be simultaneously subject to one or more than one of the forces as a result of pluralities of external factors like earthquake, wind and the own weight of the structure, and the structures shall be resistant to such conditions up to a certain degree. Accordingly, the behavior of the structure produced by means of the subject matter structure members is explained in general.

First of all, the composite material, of which the structure members are produced, is as resistant as steel, and it is a material which is 6 times lighter than steel. On the other hand, the gapped body structure used in the present invention further decreases the weight of the structure members. Thus, the component of the momentum force resulting from the own weight of the building is lower when compared with the concrete or steel structures. If the building is subject to a pressure force, the items like the brick connection recess (231), provided on the wall brick lateral surfaces (23) of the adjacent wall bricks (20), and the brick connection protrusion (232), inserted into the brick connection recess (231), and the second connection housings (223) provided on the wall bricks (20) provided one above the other, and the second connection extensions (221) inserted into the second connection housings (223), provide the structure to be resistant against said pressure forces. In case a tensile force is formed, the second connection housings (223) provided on the wall bricks (20) and the second connection extensions (221) inserted into the second connection housings (223) provide the structure to be resistant to said pressure forces. When a cutting force is faced, the items described in the pressure force are used, and additionally, unscrewed connection provides a great advantage since it provides great flexibility. For instance, when a momentum force or tore is formed due to wind, etc., again the items providing resistance against pressure forces and the unscrewed connection and the flexibility are applied. Moreover, the connection items, providing connection of the related structure members, play an important role in the resistance of the building against said forces. Since the wall bricks (20) are laid by means of sliding in each row, an upper wall brick (20) supports the interconnection of the two bottom wall bricks (20), and this provides the structure to be more rigid.

On the other hand, in a different manner from the masonry construction, the walls (80) of a structure constructed according to the present invention functions as a carrier as in the structures produced by means of the same tunnel formwork, and this provides the building to be much more resistant. On the other hand, in structures which are produced by means of the tunnel formwork, the inner walls (80) are produced in a masonry manner for decreasing the costs, in the present invention, the walls (80) forming the rooms function as a carrier in the same manner. Moreover, thanks to the rigid connection between the corner wall bricks (20*b*), T wall bricks (20*c*) and the walls (80), when the building is subject to the abovementioned loads, the corner angle is not deteriorated in an opposite manner to the other prefabricated structures or to the structures produced by means of the tunnel formwork method. Thus, the non-deteriorated corner form between at least two walls (80), extending in an orthogonal manner with respect to each other, becomes possible thanks to the special connection between the wall bricks (20) and corner wall bricks (20*b*) or T wall bricks (20*c*). Finally, even if wind passes through the bottom section of the structure, the panels (60) are not separated from the structure, and they are resistant against the vacuum load.

Moreover, the subject matter structure members do not comprise pluralities of layers having different physical and chemical properties as in the prior art, and this provides the subject matter structure members and a structure which is produced by using said members to have sufficient rigidity and strength. Moreover, the production easiness and production speed provided by means of this are important advantages.

Some test data of a subject matter structure component obtained by an example formulation are as follows:

| Tests | Test Method | Values |
|---|---|---|
| Determination of Bending Resistance ($N/mm^2$) | TS 985 EN ISO 178 | ≥160 |
| Determination of Tensile Strength (MPa) | EN ISO 527-4 | ≥222 |
| Resistance against Impact ($kj/m^2$) | EN ISO 179 | ≥110 |
| Barcol Hardness | EN59 | 70 |
| Water absorbance (%) | TS 702, ISO 62 | Max 0, 15% within 24 hours |
| Density ($gr/cm^3$) | TS 1818, ASTM D792 | 1.79 |
| Chemical Resistance (In volume 60% toluene 40% n-heptane or in diesel, under conditions of 23 ± 2° C., 168 ± hours) (TS 1478 EN 124 Annex E) | EN ISO 14125 | Max change in weight % 0.5 Change in bending resistance −20% Change in bending module −30% |
| Surface Resistance (Ω) | DIN IEC 93 | $5 \times 10^9$ |
| Volume Resistance (Ω) | DIN IEC 93 | $5 \times 10^{10}$ |
| Specific Passage Resistance (Ω · cm) | DIN IEC 93 | $1 \times 10^{12}$ |
| Ball Pressure Test | | Track diameter max. 2 mm. |
| Hot Wire Test | | There is no dripping. |
| Accelerated Heat Dampening Test | | No punch or deformation |
| Insulation Test | | No discharge and deformation |
| Test of Resistance against Temperature Changes | | No deformation and cracks |
| Test of Resistance against Ultraviolet Rays | | No deformation and cracks |

Moreover, in the related tests realized, it has been observed that the subject matter structure members do not have dripping in the hot wire test, and it has been observed that no punch and deformation occur in the accelerated heat dampening test, and it has been observed that there is no discharge and deformation in the insulation test. In addition to these, in the tests for testing resistance against temperature changes and for testing resistance against ultraviolet rays, it has been observed that no deformation and crack occur in the subject matter structure members.

The protection scope of the present invention is set forth in the annexed Claims and cannot be restricted to the illustrative disclosures given above, under the detailed description. It is because a person skilled in the relevant art can obviously produce similar embodiments under the light of the foregoing disclosures, without departing from the main principles of the present invention.

The invention claimed is:

1. A pair of structure members each having a body made of a composite material comprising at least one type of fiber at a proportion of 25-33%, at least one type of mineral powder as filling material at a proportion of 40-50%, at least one type of resin at a proportion of 20-25% as binding member between the fiber and filling material, and at least one chemical additive at a proportion of 5-8%, and a plurality of connection extensions which are one-piece with said body in order to provide connection to another structure member with the same properties, wherein at least two connection extensions are provided on a beam adaptor width section of each body, and said pair of structure members comprising a first structure member having at least one beam housing provided along at least one section of the body height and between at least one row of connection extensions provided in a beam adaptor length section of the body, and at least one second structure member placed under said first structure member and having a beam housing provided along half length of the beam adaptor width section and along half length of the height thereof;

wherein the beam housings of said first and second structure members are arranged in an overlapping manner and wherein the beam housings of said first and second structure members receive at least one beam therein allowing panels to be placed onto the beams to form a base without the need for pouring base concrete.

2. A structure member according to claim 1, further comprising at least one adaptor connection recess or at least one adaptor connection protrusion provided on at least one surface thereof facing another structure member which is horizontally adjacent.

3. A structure member according to claim 2, wherein two adaptor connection recesses or adaptor connection protrusions are provided.

4. A structure member according to claim 1, wherein each beam housing is provided along the half length of the beam adaptor width section and along the whole height thereof.

5. A structure member according to claim 1, wherein each beam housing is provided along the whole length of the beam adaptor width section and along the half-length thereof.

6. A structure member according to claim 1, further comprising a plurality of connection housings provided in the direction of the connection extensions and at the bottom section of the body.

7. A structure member according to claim 1, wherein in order to obtain a material having the mechanical properties of steels which are ST 50 and above, vinyl ester resin is used as resin, and carbon fiber is used as fiber.

8. A structure member according to claim 1, wherein in order to obtain a material having the mechanical properties of steels which are between ST 33 and ST 42, orthophthalic resin is used as resin, and glass fiber is used as fiber.

9. A structure member according to claim 1, wherein in order to obtain a material having the mechanical properties of steels which are between ST 42 and ST 50, isophthalic resin is used as resin, and aramid fiber is used as fiber.

10. A structure member according to claim 1, further comprising at least one type of mineral powder which is selected from a mineral group comprising silisium dioxide, barite, talc and calcite as the filling material.

11. A structural member according to claim 1, further including a beam configured to be received within a beam housing of two spaced apart structural members.

* * * * *